US012342927B2

(12) United States Patent
Kosecoff et al.

(10) Patent No.: US 12,342,927 B2
(45) Date of Patent: Jul. 1, 2025

(54) CONFORMABLE POINT ARRAY FOR DISCRETIZED COSMETIC DESIGN APPLICATION

(71) Applicant: L'Oreal, Paris (FR)

(72) Inventors: David B. Kosecoff, San Francisco, CA (US); Franck Giron, Clichy (FR)

(73) Assignee: L'Oreal, Paris (FR)

( * ) Notice: Subject to any disclaimer, the term of this patent is extended or adjusted under 35 U.S.C. 154(b) by 1037 days.

(21) Appl. No.: 17/364,415

(22) Filed: Jun. 30, 2021

(65) Prior Publication Data

US 2023/0000241 A1 Jan. 5, 2023

(51) Int. Cl.
*A46B 13/02* (2006.01)
*A45D 34/04* (2006.01)
(Continued)

(52) U.S. Cl.
CPC ..... *A46B 13/02* (2013.01); *A45D 34/042* (2013.01); *A45D 44/005* (2013.01); *A46B 15/0055* (2013.01)

(58) Field of Classification Search
CPC ..... A46B 13/02; A46B 15/0002; A46B 13/04; A46B 15/0004; A46B 15/0055; A45D 34/04; A45D 44/005; A45D 40/26; A45D 2200/10; A45D 34/041; A45D 2200/056; A45D 2200/1018; A45D 2200/1036; A45D 34/042; A61Q 19/00; B25J 9/1684; B25J 9/1697; B25J 9/1664; F04C 2270/0421;
(Continued)

(56) References Cited

U.S. PATENT DOCUMENTS 4,585,018 A * 4/1986 O'Connor ..... A01K 13/003 401/268
9,789,295 B2 * 10/2017 Zhou ..... A61H 7/002
(Continued)

FOREIGN PATENT DOCUMENTS

WO 2020260515 A1 12/2020

OTHER PUBLICATIONS

International Preliminary Report on Patentability for International Application No. PCT/US2022/035692, mailed Dec. 14, 2023.
(Continued)

*Primary Examiner* — David P Angwin
*Assistant Examiner* — Christopher S. Parisi
(74) *Attorney, Agent, or Firm* — CHRISTENSEN O'CONNOR JOHNSON KINDNESS PLLC

(57) ABSTRACT

Devices, systems, and methods for applying cosmetic designs to biological subjects are provided. An applicator array device may include a substrate. The applicator array device may also include, a plurality of applicator elements disposed on the substrate, together defining an applicator array. Each applicator element may include an applicator member having a length substantially orthogonal to an outer surface of the substrate, a first portion of the length extending from the outer surface of the substrate and a second portion of the applicator member extending through the substrate. The first portion may define a first end and the second portion may define a second end opposite the first end. Each applicator element may also include an applicator surface defined by the first end.

13 Claims, 10 Drawing Sheets

(51) Int. Cl.
*A45D 44/00* (2006.01)
*A46B 15/00* (2006.01)

(58) Field of Classification Search
CPC ..... G01B 11/25; G06T 2207/30201; G06T 2207/10012; G06V 40/16
USPC ..... 222/52
See application file for complete search history.

(56) References Cited

U.S. PATENT DOCUMENTS 10,324,739 B2 * 6/2019 Chou ..... G06F 3/012
11,006,726 B1 5/2021 Liu
2009/0177125 A1 * 7/2009 Pilcher ..... A61H 7/005 15/4
2012/0124758 A1 * 5/2012 Sabisch ..... A61C 17/3445 15/21.1
2015/0314141 A1 * 11/2015 Choi ..... B41J 3/407 347/110
2017/0069052 A1 3/2017 Li
2017/0256084 A1 * 9/2017 Iglehart ..... G06V 40/16
2019/0164210 A1 * 5/2019 Kornilov ..... G06V 40/165

OTHER PUBLICATIONS

French Search Report and Written Opinion, issued May 20, 2022, in corresponding French Patent Application No. 2108897, 7 pages.
Bar-Cohen, Electroactive polymers for refreshable Braille displays, SPIE, Sep. 11, 2009.
Stretchable Inks for Wearable Electronics, Dupont, Electronic Solutions, 2021.
Worrell et al., Bistable and photoswitchable states of matter, Nature Communications, 2018.
International Search Report and Written Opinion, mailed Oct. 21, 2022, issued in corresponding International Application No. PCT/US2022/035692, filed Jun. 30, 2022, 14 pages.

* cited by examiner

CONFORMABLE POINT ARRAY FOR DISCRETIZED COSMETIC DESIGN APPLICATION

SUMMARY

Devices, systems, and methods for applying cosmetic designs to biological subjects are provided. An applicator array device may include a substrate. The applicator array device may also include, a plurality of applicator elements disposed on the substrate, together defining an applicator array. Each applicator element may include an applicator member having a length substantially orthogonal to an outer surface of the substrate, a first portion of the length extending from the outer surface of the substrate and a second portion of the applicator member extending through the substrate. The first portion may define a first end and the second portion may define a second end opposite the first end. Each applicator element may also include an applicator surface defined by the first end.

In some embodiments, each applicator element may further include an actuator, disposed on the substrate and operably coupled to the applicator member, the actuator configured to reposition the applicator surface relative to the outer surface by moving the applicator member. The actuator may be or include a shape memory alloy, a micromotor, an electromagnetic coil, a pneumatic circuit, or a piezoelectric material. The applicator element may further include a spring assembly mechanically coupled with the second portion to oppose motion of the applicator surface toward the outer surface. Each applicator element may further include a compliant material disposed on the applicator surface. The compliant material may be or include a porous material.

In some embodiments, the applicator array device may further include a source of electromagnetic radiation in an energy range, the source being optically coupled with the applicator array. Each applicator member may further include an optical material that is substantially transparent to electromagnetic radiation in the energy range. Each applicator member may be optically coupled with the source to conduct the electromagnetic radiation to the applicator surface. Each applicator element may further include an electroactive polymer actuator disposed at the first end. The electroactive polymer actuator may include a first electrode, an electroactive polymer layer electronically coupled with the first electrode, and a second electrode, electronically coupled with the electroactive polymer layer. The electroactive polymer actuator may switched between a first position and a second position in accordance with an applied voltage to the electroactive polymer layer. The electroactive polymer actuator may also include a flexible layer overlying the electroactive polymer actuator and defining the applicator surface. The applicator surface may be recessed within the applicator member when the electroactive polymer actuator is in the second position. The applicator surface may extend proud of the first end when the electroactive polymer actuator is in the first position.

In some embodiments, the applicator array device may further include a pigment reservoir and a fluid conduit coupled with the pigment reservoir. The applicator member further comprises a channel coupled with the pigment reservoir via the fluid conduit, the channel terminating at the applicator surface. The applicator array device may further include one or more processors, control circuitry in electronically coupled with the one or more processors and the applicator elements, and a non-transitory computer readable memory in electronic communication with the one or more processors and storing instructions that, when executed by the one or more processors, cause the one or more processors to perform operations including receiving a cosmetic design describing a configuration of the applicator elements and initializing the applicator array in accordance with the design. Initializing the plurality of applicator elements may include repositioning a subset of the applicator members relative to the outer surface.

A system for application of cosmetic designs may include a client computing device configured to generate a cosmetic design, an applicator array device as previously described, and a pigment applicator configured to reversibly couple with the applicator array device and to apply a pigment to a subset of the plurality of applicator members.

In some embodiments, the pigment applicator may include control circuitry, communication circuitry, and a controllable pigment applicator head. The pigment applicator may be configured to electronically couple with the client computing device. The pigment applicator may be configured to print the pigment onto the subset of the applicator members in accordance with the cosmetic design. The subset may be a first subset and the applicator array device may be electronically coupled with the client computing device. The applicator array device may be configured to receive the cosmetic design from the client computing device or the pigment applicator. The applicator array device also may be configured to initialize the applicator array in accordance with the cosmetic design. Initializing the applicator array may include retracting a second subset of the applicator members toward the outer surface, the second subset being different than the first subset.

In some embodiments, the system may further include a camera. The client computing device may include one or more processors and a non-transitory computer readable medium storing instructions that, when executed by the one or more processors of the client computing device, cause the one or more processors to execute operations including capturing an image describing a target body surface using the camera, generating a surface mapping of the target body surface using the image, and generating the cosmetic design using the surface mapping. Generating the cosmetic design may include defining a plurality of relative positions corresponding to the applicator elements, and wherein the relative positions together define a negative surface corresponding to the target body surface.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

Figure 1:
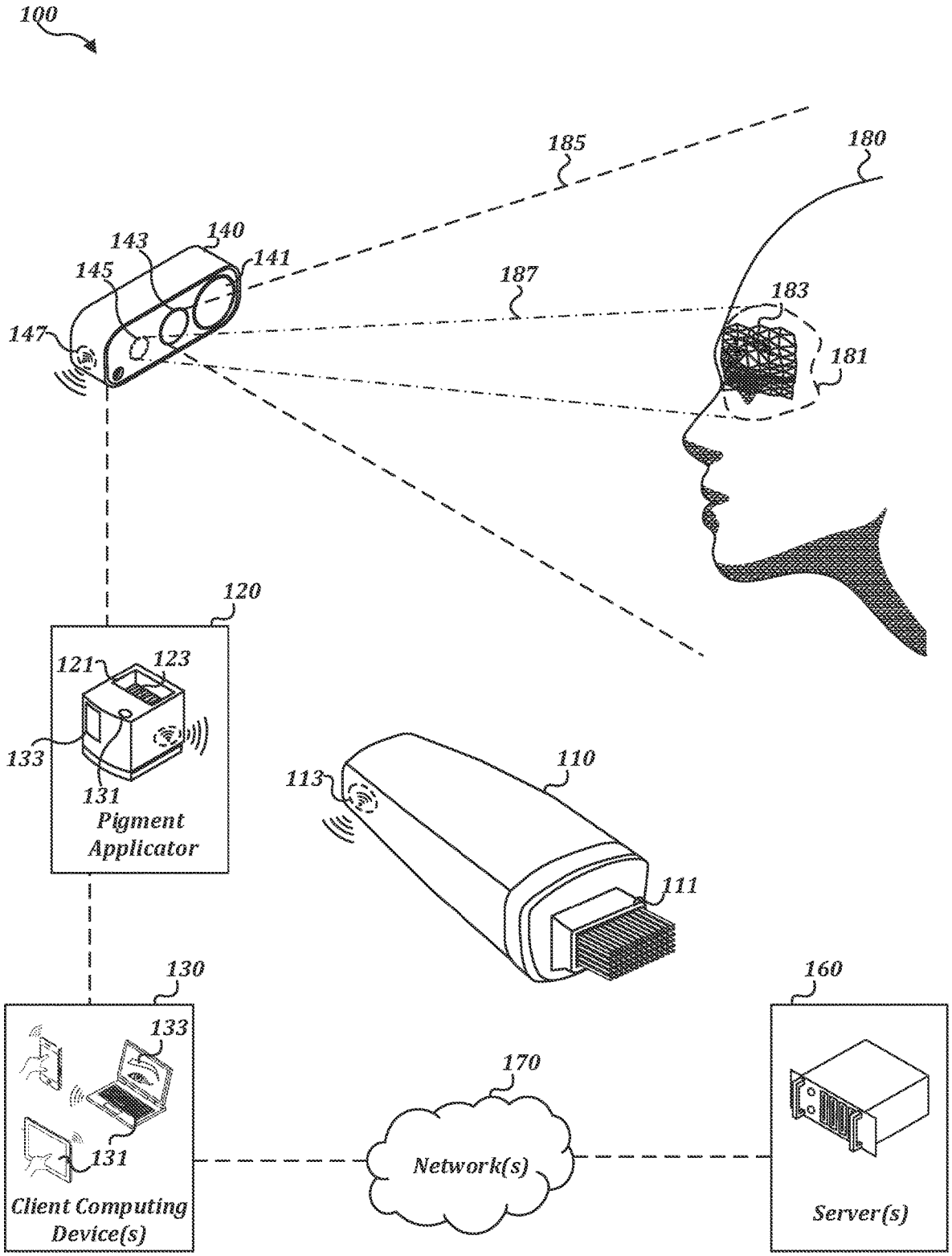
FIG. 1 is a schematic illustration of an embodiment of a system for application of cosmetic designs, in accordance with various embodiments.

The foregoing aspects and many of the attendant advantages of this invention will become more readily appreciated as the same become better understood by reference to the following detailed description, when taken in conjunction with the accompanying drawings.

In the above-referenced drawings, like reference numerals refer to like parts throughout the various views unless otherwise specified. Not all instances of an element are necessarily labeled to simplify the drawings where appropriate. The drawings are not necessarily to scale, emphasis instead being placed upon illustrating the principles being described.

DETAILED DESCRIPTION

Application of cosmetics and makeup in patterns and shapes can be difficult by hand. For example, intricate designs and theatrical makeup are typically applied by certified makeup professionals. Additionally, self-application can be a challenge generally for those with limited mobility or vision. Currently, handheld tools, such as cartridge-plus-dispenser solutions, typically implement printed and/or patterned makeup application through a unitary printing head to apply the final design directly to the skin. Despite representing a technological alternative to brushes, such tools are limited by cartridge sizes, cleaning methods, inability to mix or blend colors, short battery life, and lack of location awareness. Also, by depending on a handheld device, such tools do not address accessibility concerns.

Techniques are described for applying a cosmetic design guide to a target body surface of a biological subject, such as a subject's face or other region of interest, using an applicator array device. Described embodiments employ electrical and/or mechanical actuation to initialize an applicator array including multiple applicator elements that each include an applicator member defining an applicator surface, to which a pigment may be applied. Subsequent initialization, a pigment may be selectively applied to a subset of the applicator elements in accordance with a cosmetic design or cosmetic design guide. Transferring the cosmetic design guide to the target body surface aids in the application of cosmetics in accordance with a cosmetic design. The techniques, therefore, improve the manual application of cosmetics.

Described embodiments include using image sensors to define one or more contour mappings of the target body surface using a 3D mapping of the target body surface. Described embodiments are useful in many contexts, including cosmetics or body art applications, skin feature mapping or monitoring, dermatological diagnosis or treatments, or telehealth applications. In the context of such applications, described embodiments provide precision and greater ease of use over complex manual routines.

The forthcoming description focuses on embodiments of a system for applying cosmetic designs and/or cosmetic design guides, but embodiments are not limited as such. In some embodiments, the systems, methods, and materials described include techniques for applying cosmetic treatments to a target body surface. The cosmetic treatments may include, but are not limited to, cosmetic treatments directed at reducing the appearance of skin lines, wrinkles, loose skin, acne, scars, or other aesthetic treatments. The cosmetic treatments may be implemented through application of active ingredients additionally or alternatively to cosmetic pigments. For example, devices described herein may apply ultraviolet-absorber material, antipruritic material, and/or antiseptic materials, as part of a cosmetic design to conceal and treat features including, but not limited to blemishes, acne, cuts, or scars. In this way, the cosmetic treatments may impart similar cosmetic benefits as treatments employing both cosmetic formulations and active ingredients.

FIG. 1 is a schematic illustration of an example system 100 for application of cosmetic designs, in accordance with various embodiments. The example system 100 includes an applicator array device 110, a pigment applicator 120, one or more client computing devices 130, a camera 140, and one or more remote computer systems 160, also referred to as server(s). As part of the example system 100, the constituent system components may be operably coupled through wireless communication and/or through wired communication. In some embodiments, constituent components may communicate directly through wireless pairing (e.g., Bluetooth) and/or via a local wireless network (e.g., through a wireless router). In some embodiments, constituent components may communicate over one or more networks 170, which may be or include a public network (e.g., the internet) or a private network (e.g., an intranet). In this way, the example system 100 may include multiple distinct devices configured to communicate electronic information through wireless connections. Additionally or alternatively, some of the constituent components may be integrated into a single device.

As an illustrative example, the pigment applicator 120 may integrate the client computing device 130 and/or the camera 140. Similarly, the client computing device 130 may incorporate the camera 140 and/or the pigment applicator 120. Similarly, the example system 100 may include multiple client computing devices 130, where a first client computing device 130 is a mobile electronic device (e.g., a tablet, smartphone, or laptop) that is configured to host user interface elements and to connect to the server(s) 160 over the network(s) 170, while a second client computing device 130 is integrated with the pigment applicator 120 and the camera 140 and is configured to coordinate the operation of the applicator array device 110 with the first client computing device 130. As described in more detail in reference to FIG. 9, the constituent components of the example system 100 may be provided with computer-executable instructions (e.g., software, firmware, etc.) to implement and coordinate the operation of one or more features of the example system 100. In this way, the operation of the example system 100 may be coordinated via a user interface, accessed via one or more of the constituent components.

As described in more detail in reference to FIGS. 2-9, the applicator array device 110 may incorporate electronic components including, but not limited to, control circuitry, power supply circuitry, and communication circuitry. In some embodiments, the applicator array device 110 receives a cosmetic design from one or more constituent components of the example system 100 and initializes an applicator array 111 in accordance with the cosmetic design. The applicator array device 110 may receive the cosmetic design through communication with one or more of the constituent components of the example system 100, for example, through wireless communication circuitry 113, including but not limited to a near-field radio transmitter/receiver (e.g., WiFi, Bluetooth, etc.), an infrared optical link, or other data transmission techniques. In some embodiments, the applicator array device 110 may receive the cosmetic design(s) from the client computing device 130. In some embodiments, the applicator array device 110 may receive the cosmetic design(s) from the client computing device 130 via a link with the pigment applicator 120. For example, the applicator array device 110 and the pigment applicator 120 may communicate automatically (e.g., without human intervention) either wirelessly or through a reversible physical coupling (e.g., through communication circuitry including electrical contacts). In this way, cosmetic design data may be transferred either directly to the applicator array device 110 (e.g., over the network 170 or through a wireless pairing with the client computing device(s) 130), or indirectly via the pigment applicator 120.

The applicator array device 110 may include electronic circuitry to individually address multiple applicator elements that together define the applicator array 111, as described in reference to FIGS. 3-9. The applicator elements may include applicator members that are individually addressed and may be actuated between a raised position and a neutral or recessed position. In this way, the cosmetic designs received by the applicator array device 110 may be or include an array of binary values (e.g., a "true" value and a "false" value) corresponding to the applicator elements making up the applicator array 111. The applicator array device 110 may initialize the applicator array 111 in accordance with the binary values, where each value may correspond to an individual applicator element of the applicator array 111.

The pigment applicator 120 may be or include electronic circuitry and/or mechanical components to selectively apply pigment to one or more applicator elements making up the applicator array 111. In some embodiments, the pigment applicator 120 includes a mechanical coupling 121 that is fitted to receive or otherwise reversibly join with the applicator array 111 and/or the applicator array device 110, such that an operative surface of the applicator array 111 contacts the pigment applicator. For example, the pigment applicator 120 may be or include an applicator 123 including a pigment applicator pad, positioned such that only the applicator element(s) that are in the raised position (e.g., the "true" position in the cosmetic design) are contacted during the reversible coupling with the applicator array device 110. In this way, the pigment applicator 120 may provide a controlled application of pigment to each applicator member that corresponds to a true position in the cosmetic design while leaving applicator members corresponding to a "false" position in the design substantially free of pigment. In this context, the term "substantially" is used to describe a condition where a limited or a negligible amount of pigment remains or is deposited on elements not directly contacting the pigment applicator pad. In some embodiments, the mechanical coupling 121 may include charging contacts to transfer electrical power to the applicator array device 110, for example, to charge batteries internal to the applicator array device 110.

In some embodiments, more than one pigment may be applied by the pigment applicator 120. For example, the applicator 123 may include multiple applicator pads corresponding to different colors or types of pigments and may include mechanisms for exchanging the applicator pads between an operative position and an inoperative position. In this way, the pigment applicator 120 may initialize the applicator 123 by selecting an appropriate pigment corresponding to a received cosmetic design but may also change pigments during application of pigment to the applicator array 111.

In some embodiments, the applicator 123 includes a controllable pigment applicator head. The pigment applicator head may be or include a controllable nozzle, ribbon, or other pigment source that is driven to positions in a plane (e.g., using an x-y translation stage) that correspond to the applicator elements of the applicator array 111 that are extended from the operative surface of the applicator array 111. In an illustrative example, the pigment includes charged components, such as ionic species, and the pigment is applied to the applicator element(s) through reversible application of an electric field using the pigment applicator head. In another example, the pigment applicator head may include a ribbon saturated with the pigment that is impacted by a driven tip, such that the ribbon is between the driven tip and the applicator member. Other examples of applicator heads include, but are not limited to, a brush, a roller, or a marker.

Figure 3:
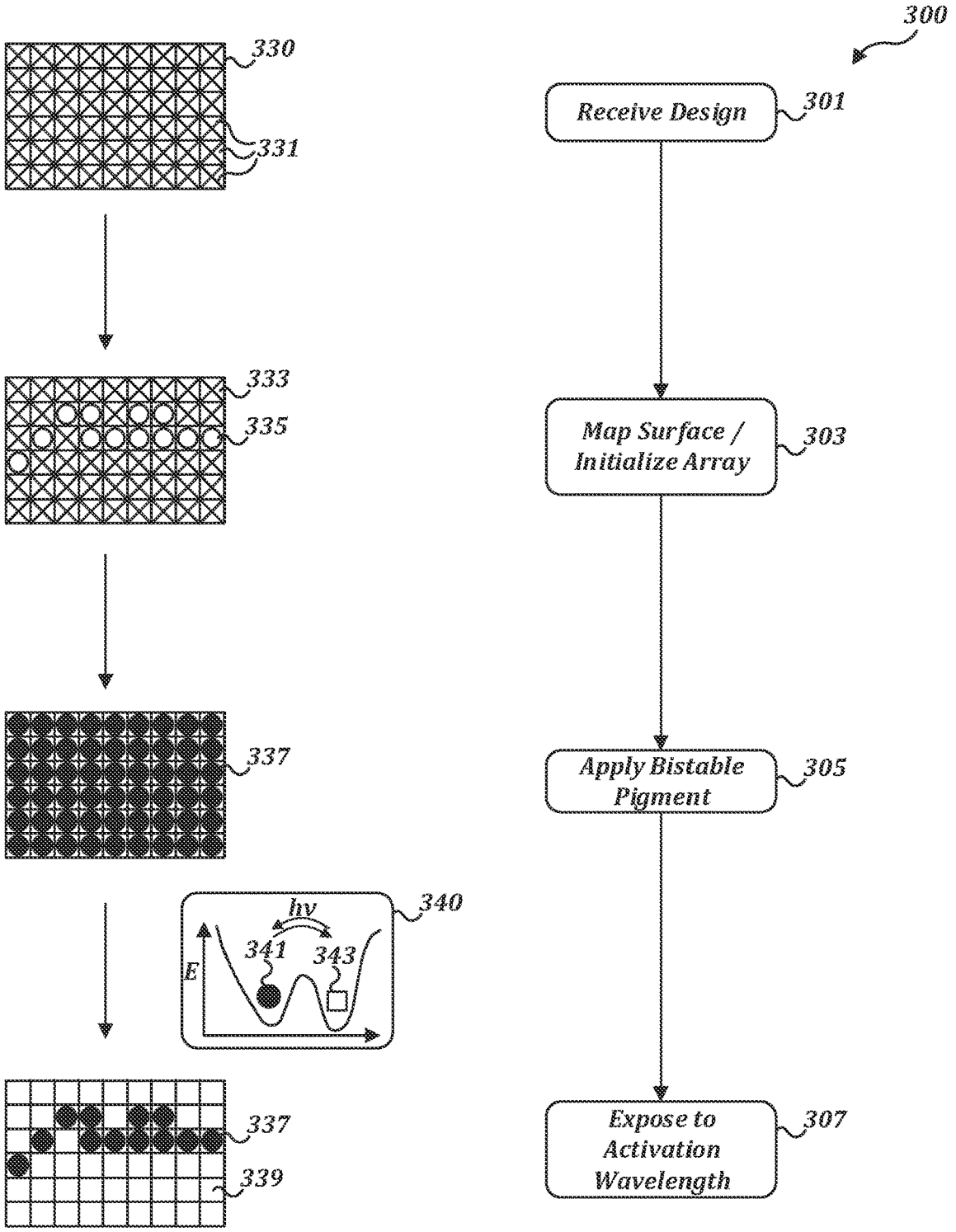
FIG. 3 is a schematic illustration of an example technique for preparing a cosmetic design using an applicator array device and bi-stable materials, in accordance with various embodiments.

As described in more detail in reference to FIG. 3, the pigment applicator 120 or the applicator array device 110 may include one or more sources of electromagnetic radiation, also referred to as an EM source(s), that is/are calibrated to switch a bistable formulation between a solid or viscous form and a liquid or fluid form. The pigment applicator 120 may incorporate the EM source(s) as part of the pigment applicator head, such that the bistable formulation may be applied generally onto the applicator array 111 as a liquid or fluid, and may be switched to a solid through exposure to the EM source(s) at the positions on the applicator array 111 corresponding to "true" values in the cosmetic design. Similarly, the applicator array device 110 may incorporate the EM source(s), as described in more detail in reference to FIG. 7.

The client computing device(s) 130 may be or include a purpose-built mobile computing device including the pigment applicator 120 and/or the camera 140, one or more EM sources, and one or more user interface elements 131 to prompt the subject with visual and/or auditory prompts. For example, the interface elements 131 may be or include a display 133 to generate a visual representation of the cosmetic design. The interface elements 131 may also include user input components including, but not limited to, touch screen, keyboard, trackpad, or mouse. In this example, the components of the client computing device 130 may be integrated into a housing resembling a consumer cosmetic product such as, for example, an electric shaver dock. In this example, the housing may conceal power sources, heat management systems, and other components.

While the pigment applicator 120, client computing device 130, and camera 140 are illustrated in a particular configuration, additional and/or alternative form factors are contemplated. For example, the system 100 may include a smartphone or tablet computer in communication with the client computing device 130, such that one or more computer-executable operations are undertaken by the smartphone or tablet computer rather than by the pigment applicator 120 or the applicator array device 110. In this way, the pigment applicator 120 may have a form factor including, but not limited to, a cosmetics compact or an electronic peripheral configured to electronically couple with a smartphone or tablet computer that includes the camera 140.

In some embodiments, the camera 140 may be or include multiple sensors and/or sources including, but not limited to a visible light image sensor 141, a depth sensor 143 and/or a source of invisible EM radiation 145, including but not limited to infrared or near-infrared radiation. As with the applicator array device 110, the pigment applicator 120, and the client computing device(s) 130, the camera 140 may include communication circuitry 147 to enable wireless communication and/or pairing with the other constituent components of the example system 100. While the camera 140 is illustrated as a separate component of the example system 100, the camera 140 may also be integrated into one of the other constituent components of the example system 100. For example, the client computing device 130 may incorporate the camera 140. Similarly, the applicator array device 110 and/or the pigment applicator may incorporate the camera 140.

The depth sensor 143 may capture one or more images of a biological subject 180, including, but not limited to, images of a target body surface 181 of the biological subject 180. In the illustration provided in FIG. 1, the biological subject 180 is a human user of the example system 100 and the target body surface 181 is the face of the human user in the region around the eye and eyebrow. The depth sensor 143 may generate a surface mapping 183 of the target body surface 181. Contours and depth information for the target body surface 181 may vary over time or between users, and the camera may generate the surface mapping 183 as part of operations for modifying and/or generating a cosmetic design by the client computing device(s) 130. The depth sensor 185 may be an image sensor and may capture images within a field of view 185 including the target body surface 181. The depth sensor 143 may be or include, but is not limited to, a laser-based sensor (e.g., LiDAR), a time-of-flight camera, a vSLAM sensor assembly, or an ultrasound-based sensor assembly, such that the camera 140 may generate the surface mapping 183. For example, where the depth sensor is an infrared depth sensing camera, the source of invisible EM radiation 145 may be or include an infrared source that exposes the biological subject 180 including the target body surface 181 to invisible infrared radiation. In another example, where the depth sensor is a LiDAR system or a time-of-flight camera, the source of invisible EM radiation 145 may be or include an infrared diode laser. In this way, the EM radiation generated by the source of invisible EM radiation 145 may be scanned or otherwise directed toward the target body surface 181 over an angular spread 187, such that only the target body surface 181 is exposed. In some embodiments, detection of the target body surface 181 is facilitated and/or enabled by feature and/or edge detection applied to visible spectrum (e.g., RGB) images captured by the visible light sensor 141 (e.g., by vSLAM techniques).

The surface mapping 183 may provide contour information and/or position information for features in the target body surface 181, for example, precise information about the relative position of the eyebrow ridge and the bridge of the nose, where the eyebrow begins and ends relative to the eye, etc. In this way, the surface mapping 183 may be used to generate or modify the cosmetic design by determining a subset of applicator elements of the plurality of applicator elements to switch from the neutral or recessed position to the raised position. Similarly, where the cosmetic design may be received from the server 160, for example, as part of an online platform and/or database of cosmetic designs, the surface mapping 183 may be used to modify the cosmetic design by determining a subset of applicator elements of the plurality of applicator elements to switch from the raised position to the neutral or recessed position. In some embodiments, multiple incremental positions are defined as part of generating or modifying the cosmetic design. For example, the applicator members of the applicator array 111 may be positioned between the neutral or recessed position and the raised position as an approach to defining a negative surface that is complementary to the surface mapping 183.

Figure 2:
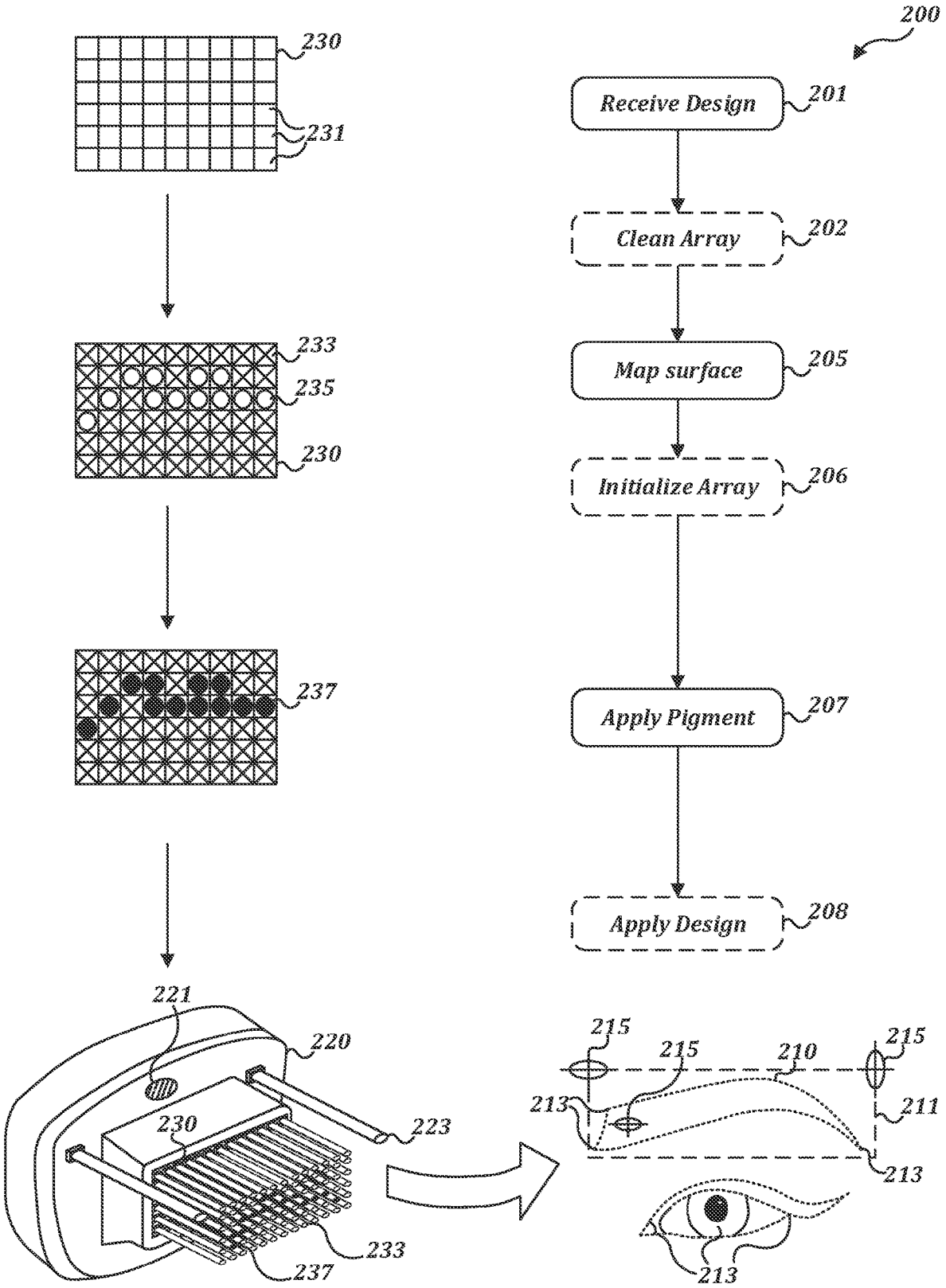
FIG. 2 is a schematic illustration of an example technique for preparing a cosmetic design using an applicator array device, in accordance with various embodiments.

FIG. 2 is a schematic illustration of an example technique 200 for preparing a cosmetic design using an applicator array device, in accordance with various embodiments. The example technique 200 may be implemented as a number of operations executed or otherwise performed by the example system 100 of FIG. 1. In this way, the operations may be or include operations performed by one or more processors of a computer system (e.g., applicator array device 110 of FIG. 1) in response to execution of computer-readable instructions stored on non-transitory memory of the computer system. While the operations are illustrated in a particular order, the example technique 200 may include more or fewer operations, and the order of operations may vary. In some embodiments, one or more operations are performed by multiple components of a system, as described in more detail in reference to FIG. 1. For example, some operations may be performed by different components interchangeably or may be performed by coordinated operation of two or more components.

At operation 201 the example technique 200 includes receiving a cosmetic design 210. In some embodiments, the cosmetic design 210 is a design guide including multiple points of pigment to be transferred onto a surface 211 (e.g., target body surface 181 of FIG. 1) of a biological subject (e.g., biological subject 180 of FIG. 1), such as a human. In some embodiments, the cosmetic design 210 is a complete cosmetic design that may include multiple colors and/or shades corresponding to different regions of the surface.

In some embodiments, the cosmetic design 210 is received by an applicator array device 220 (e.g., applicator array device 110 of FIG. 1) as a numerical representation of the design, including a dataset of true values and false values corresponding to a number of applicator elements 231 that together define an applicator array 230 of the applicator array device 220. The applicator array 230 may include the applicator elements 231 arranged in one or more configurations. As illustrated, the applicator array 230 includes applicator elements 231 arranged in a rectangular matrix. In some embodiments, the applicator elements 231 are arranged in configurations including, but not limited to ellipsoidal or circular arrays, triangular arrays, square arrays, pentagonal arrays, hexagonal arrays, heptagonal arrays, octagonal arrays, or higher order polygonal arrays. The configurations are not limited to regular polygons and include oblong arrays and irregular polygons. For example, the applicator array 230 may be configured as a trapezoidal array of applicator elements 231.

Operations for receiving the cosmetic design may include one or more data transfer techniques including, but not limited to, wireless communication or wired communication. For example, the applicator array device 220 may communicate wirelessly with a client computing device (e.g., client computing device 130 of FIG. 1) to receive the cosmetic design 210 as a wireless transmission. In another example, the applicator array device 220 may communicate through a temporary physical coupling with a pigment applicator (e.g., pigment applicator 120 of FIG. 1) to receive the cosmetic design 210 via electronic transfer (e.g., through a Universal Serial Bus-type connection).

As described in more detail in reference to FIG. 1, the cosmetic design 210 may be or include information describing a neutral position 233 of a first subset of the applicator elements 231 and a raised position 235 of a second subset of the applicator elements 231. The terms "neutral" and "raised" are used here to describe a "false" and "true" value in the cosmetic design 210, respectively, rather than an absolute position. For example, the "raised" position may describe a default position of an applicator element 231, while the "neutral" position may describe a recessed position beneath an outer surface of the applicator array. In this way, the default position of the applicator elements 231 may be the neutral position 233 or the raised position 235.

Illustrative examples of the cosmetic design 210 are described in reference to a binary dataset. In some embodiments, the cosmetic design 210 includes additional intermediate states between true and false states that correspond to intermediate positions of the applicator elements 231 between the neutral position 233 and the raised position 235. In this way, the cosmetic design 210 may also include information for shading, shaping, color, as well as other aesthetic features. In an illustrative example the cosmetic design 210 may include one or more portions in a lighter shade or with smaller points, to indicate a lighter application of cosmetic formulation or a different color.

In some embodiments, the example technique 200 may optionally include cleaning the applicator array 230 at operation 202. Cleaning the applicator array 230 may include, but is not limited to, applying a solvent or other removal formulation to the applicator array 230, at least partially submerging the applicator array 230 in a bath of the solvent or other removal formulation, exposing the applicator array 230 to ultrasonic energy (e.g., pulsed ultrasound) through a liquid that may include the solvent or other removal formulation, and/or mechanical removal such as wiping, scrubbing or pressing. In some embodiments, the pigment applicator incorporates circuitry and components to facilitate cleaning operations. For example, the pigment applicator may include a reservoir of cleaning fluid and an ultrasonic resonator (e.g., a sonic bath) to which the applicator array device 220 can reversibly couple, at least partially submerging the applicator array 230. In this way, residual pigment may be removed from the applicator array 230 and its constituent applicator elements 231. While cleaning is described as an optional operation of the example technique 200, it is understood that cleaning may also be included as part of initializing the applicator array 230. For example, where some of the operations of the example technique 200 are performed while the applicator array device 220 is reversibly coupled with the pigment applicator, cleaning and initializing may be performed concurrently (e.g., at least partially overlapping in time), under the control of one or more processors of the pigment applicator and/or the applicator array device 220.

Subsequent receiving the cosmetic design 210, the example technique 200 includes mapping the surface at operation 205. As described in more detail in reference to FIG. 1, mapping the surface may include one or more operations to generate a contour map of a target surface (e.g., target body surface 181 of FIG. 1). The contour map, thus generated, may be used to project and/or modify the received cosmetic design, as an approach to improving the precision and accuracy of the cosmetic design. In an illustrative example, a length of each applicator member of the applicator elements together defining the applicator array may be defined by the contour map, such that the applicator array may define a negative surface that complements the target body surface. Additionally or alternatively, modifying the cosmetic design may include re-assigning one or more of the applicator elements from a false value to a true value, or vice versa, based on a prediction of accuracy or precision of the transferred pigment pattern. For example, in some cases the contour map may indicate that two applicator surfaces may overlap or otherwise be unresolved when contacting the surface. To address the potential consequent loss of design resolution, a subset of the applicator elements may be modified from true to false, such that the design may be cleanly transferred to the target body surface.

Subsequent mapping the surface, the example technique 200 may optionally include initializing the applicator array 230 at operation 206. Prior to operation 206, the applicator elements 231 may be in various positions, for example, resulting from a previous iteration of the example technique 200. In this way, initializing the applicator array 230 refers to one or more processes to place the applicator elements 231 of the applicator array 230 into the positions corresponding to the cosmetic design 210. For example, initializing the applicator array 230 may describe repositioning a subset of the applicator elements 231 from the raised position 235 to the neutral position 233. Similarly, initializing the applicator array 230 may describe repositioning a subset of the applicator elements 231 from the neutral position 233 to the raised position 235. In some embodiments, initializing the applicator array 230 includes returning the applicator elements 231 to a default position or to a cleaning position prior to switching the applicator elements 231 to the neutral or raised positions.

Subsequent mapping the surface, the example technique 200 includes applying a pigment 237 to a portion of the applicator array 230 at operation 207. Applying the pigment 237 may include selectively applying pigment(s) 237 to the applicator elements 231 in the raised position 235, in accordance with the cosmetic design 210. In this context, "selectively" may refer to passively applying pigment to the applicator elements 231 that contact a pigment source (e.g., a pigment pad), but may also refer to an active process where an addressable applicator head may be automatically directed to apply the pigment 237 to the applicator elements 231 in the raised position 235. As described in more detail in reference to FIG. 1, the pigment applicator may facilitate the active process by incorporating the addressable applicator head, which may be controlled by circuitry of the pigment applicator and/or the applicator array device 220.

In some embodiments, the example technique 200 may optionally include applying the cosmetic design 210 to the surface 211 at operation 208. Applying the cosmetic design 210 may include, but is not limited to, manually guiding the applicator array device 220, carrying the pigment 237 applied to the applicator array 230 in accordance with the cosmetic design 210, to a precise position on the surface 211. Precise application may be facilitated by making reference to features 213 of the surface 211 or near the surface 211 that guide or otherwise align the applicator array 230 relative to the features 213. For example, a mapping of the surface 211 may be generated and may detect edges, depth information, and/or contours of the surface 211. The mapping may be referenced to register where on the surface 211 to apply the pigment.

In some embodiments, one or more registration marks 215 may be placed on the surface 211, for example, by manually indicating one or more of the features 213. The registration mark(s) 215 may be or include a temporary pigment, including but not limited to an acid-base unstable pigment or an ultraviolet- and/or heat-sensitive pigment, selected to leave negligible visible indication after a characteristic period of time for indoor and/or outdoor use. In some embodiments, the registration mark(s) 215 may be applied to the surface 211 within the area described by the cosmetic design 210. In this way, the registration mark(s) 215 may be occluded by the eventual deposition of pigment in accordance with the cosmetic design 215, after the applicator array device 220 has been applied to the surface 211.

In some embodiments, the applicator array device 220 includes one or more emitters 221 to project the registration mark(s) 215 onto the surface 211. An emitter 221 may be or include, but is not limited to, a projector, a coherent radiation source (e.g., a laser), or a collimated source (e.g., a light-emitting diode configured with beam-shaping optics). The emitter(s) 221 may be calibrated to emit one or more patterns onto the surface 211 to indicate the position of the applicator array 230 relative to the surface 211. In an illustrative example, the emitter 221 may emit a line onto the surface 211 indicative of the application position of the applicator array 230. In this way, the applicator array 230 may be guided to the correct position on the surface by aligning the projection generated by the emitter 221 with the registration mark 215. While an emitter 221 is illustrated external to the applicator array 230, the emitter(s) 221 may be disposed between the applicator elements 231 of the applicator array 230. For example, an emitter 221 may be a calibrated to emit one or more patterns or beams onto the surface 211 from a point- and/or line-source located on the operative surface of the applicator array 230 (e.g., a beam-forming optic being optically coupled to one or more light-emitting diodes positioned within the body of the applicator array device 220). In this way, the emitter 221 may project a pattern and/or beam onto the surface 211 without occlusion by the applicator array 230 when the applicator array device 220 approaches the surface 211.

The applicator array device 220 may also include one or more registration elements 223, which may be or include alignment pins at one or more positions relative to the applicator array 230. In some embodiments, the registration elements may be spring-loaded retract once in contact with the surface 211. In this way, the applicator array 230 may contact the surface 211 after depressing the registration elements, as an approach to improving precision of applying the cosmetic design 210. In some embodiments, the emitter (s) 221 project the registration mark(s) 215 to indicate to a user where to place the registration element(s) 223 on the surface 211.

In some embodiments, applying the design includes multiple iterations of the operations of example technique 200. For example, a complete cosmetic design may include application of multiple colors or layers. As such, the operations may be repeated for each color. In some embodiments, the cosmetic design 210 differs between iterations, in accordance with different design features.

While the description of the example technique 200 has focused on cosmetic guides for eyebrow/eye regions, the operations may similarly be applied to other surfaces 211. For example, the cosmetic design 210 may describe application of cosmetic formulations to additional/alternative surfaces 211 including, but not limited to, lips, nose, cheeks, forehead, or hands. Similarly, cosmetic designs 210 may be generated to modify the appearance of cosmetic features, including but not limited to eyebrows, eyes, lips, cheekbones, jawline, or hands. Cosmetic designs 210 may also be generated to conceal aspects of the surface 211 including, but not limited to, blemishes, scars, or burns. In an illustrative example, the example technique 200 may be applied to conceal an acne blemish by application of a first cosmetic design 210 in a first pigment to indicate where on the surface 211 to apply a foundation, and a second cosmetic design in a second pigment to indicate where to apply a concealer. In another illustrative example, a cosmetic design 210 may include a template for emphasizing the appearance of cheekbones.

In some embodiments, applying the design may include transferring the design from the applicator array device 220 to a molded surface and thence from the molded surface to the surface 211. In an illustrative example, a compliant material, such as a foam incorporating phase-change material inclusions, may be reversibly molded to the lips, eyebrow, or other surface 211. In this way, the compliant material may take on the form of a negative surface complementary to the surface 211. Applying the cosmetic design 210 to the compliant material and then to the surface 211 may multiple designs to be overlaid with improved precision, and may permit different regions and designs to be mapped and coordinated (e.g., eye-shadow guides, eyebrow guides, and cheekbone guides), for example, in a single application step.

FIG. 3 is a schematic illustration of an example technique 300 for preparing a cosmetic design using an applicator array device and bi-stable materials, in accordance with various embodiments. The example technique 300 may be implemented as a number of operations executed or otherwise performed by the example system 100 of FIG. 1. In this way, the operations may be or include operations performed by one or more processors of a computer system (e.g., applicator array device 110 of FIG. 1) in response to execution of computer-readable instructions stored on non-transitory memory of the computer system. While the operations are illustrated in a particular order, the example technique 300 may include more or fewer operations, and the order of operations may vary. One or more operations of the example technique 300 may be included as constituent operations of the example technique 200 described in reference to FIG. 2 (e.g., operation 207 of FIG. 2).

At operation 301, an applicator array device, which may be an example of applicator array device 110 of FIG. 1 and/or applicator array device 220 of FIG. 2, receives a cosmetic design (e.g., cosmetic design 210 of FIG. 2). The applicator array device may include an applicator array 330 including applicator array elements 331 that together define the applicator array 330. While the applicator array 330 is illustrated as a rectangular matrix, the applicator array 330 may assume other shapes, as described in more detail in reference to FIG. 2.

Subsequent receiving the cosmetic design, the example technique 300 includes mapping the surface and/or initializing the array 330, at operation 303. As described in more detail in reference to FIG. 2, mapping the surface may include defining relative positions of the constituent applicator elements 331 together defining the applicator array 330, to define a negative surface complementary to a target surface (e.g., surface 211 of FIG. 2). In some embodiments, mapping the surface includes modifying the design received to reflect the contours of the target surface.

The applicator elements 331 may be in any position relative to the surface of the applicator array prior to initialization. For example, a subset of the applicator elements 331 may be in a neutral or recessed position 333 and a different subset may be in a raised position 335. Initializing the applicator array 330 may include repositioning at least some of the applicator elements 331 between the neutral or recessed position 333 and the raised position 335, in accordance with the cosmetic design received at operation 301.

Subsequent mapping/initializing the applicator array 330, the example technique 300 includes applying a bistable pigment 337 at operation 305. In this context, the term "bistable" refers to a polymeric material that absorbs electromagnetic radiation at a characteristic energy (hv) to form crosslinking bonds that may be reversed upon exposure to different EM radiation in the UV/visible spectral ranges. Formation of the temporary crosslinking bonds may shift the bistable pigment 337 from a fluid 341 to a solid 343, and removal of crosslinking bonds may shift the bistable pigment 337 from a solid 343 to a liquid 341. In some embodiments, the fluid 341 may be characterized by a viscosity that permits the bistable pigment 337 to transfer to the surface (e.g., surface 211 of FIG. 2). In contrast, the solid 343 may be or include a solid and or a viscous fluid, either of which may be resistant to transfer onto the surface. In this way, the resulting applicator array 330 may be patterned by localized exposure to the activation wavelength to switch the bistable pigment 337 from one phase to another, leaving a subset of the applicator elements 331 with bistable pigment 337 as liquid 341. In some embodiments, the cosmetic design is formed by patterning the bistable pigment 337 without initializing the applicator array 330.

Without being bound to a physical mechanism of action, the bistable pigment 337 may be or include a polymer matrix incorporating a thioester functional group. The thioester functional group may participate in an exchange reaction with free thiol as promoted by a base catalyst. The exchange reaction may be modulated by mild basic or mild acidic catalysts, which are released by exposure of the polymer matrix to EM radiation at the characteristic activation wavelength(s) at operation 307. Examples of the characteristic activation wavelength may include, but are not limited to, wavelengths in a range from 300 nm to 500 nm. For example, the characteristic activation wavelength may be 320 nm, 330 nm, 340 nm, 350 nm, 360 nm, 370 nm, 380 nm, 390 nm, 400 nm, 410 nm, 420 nm, 430 nm, 440 nm, 450 nm, 460 nm, 470 nm, 480 nm, 490 nm, 500 nm, 510 nm, 520 nm, 530 nm, 540 nm, 550 nm, or interpolations thereof (e.g., 455 nm). Furthermore, the photo-mediated release of acid/base catalysts may exhibit spatial and temporal localization of phase-switching of the bistable pigment 337. In this way, phase-switching may be localized to the applicator elements 331 in the raised position 335 from solid 343 to liquid 341, or may be localized to the applicator elements 331 in the neutral or recessed position 333 from liquid 341 to solid 343. As described in more detail in reference to FIG. 7, the individual applicator elements 331 may be optically coupled with an EM source that is incorporated into the applicator array device. In this way, the bistable pigment 337 may be exposed to the EM radiation and switched from fluid 337 to solid 339, or vice versa, directly by the applicator array device.

Figure 4:
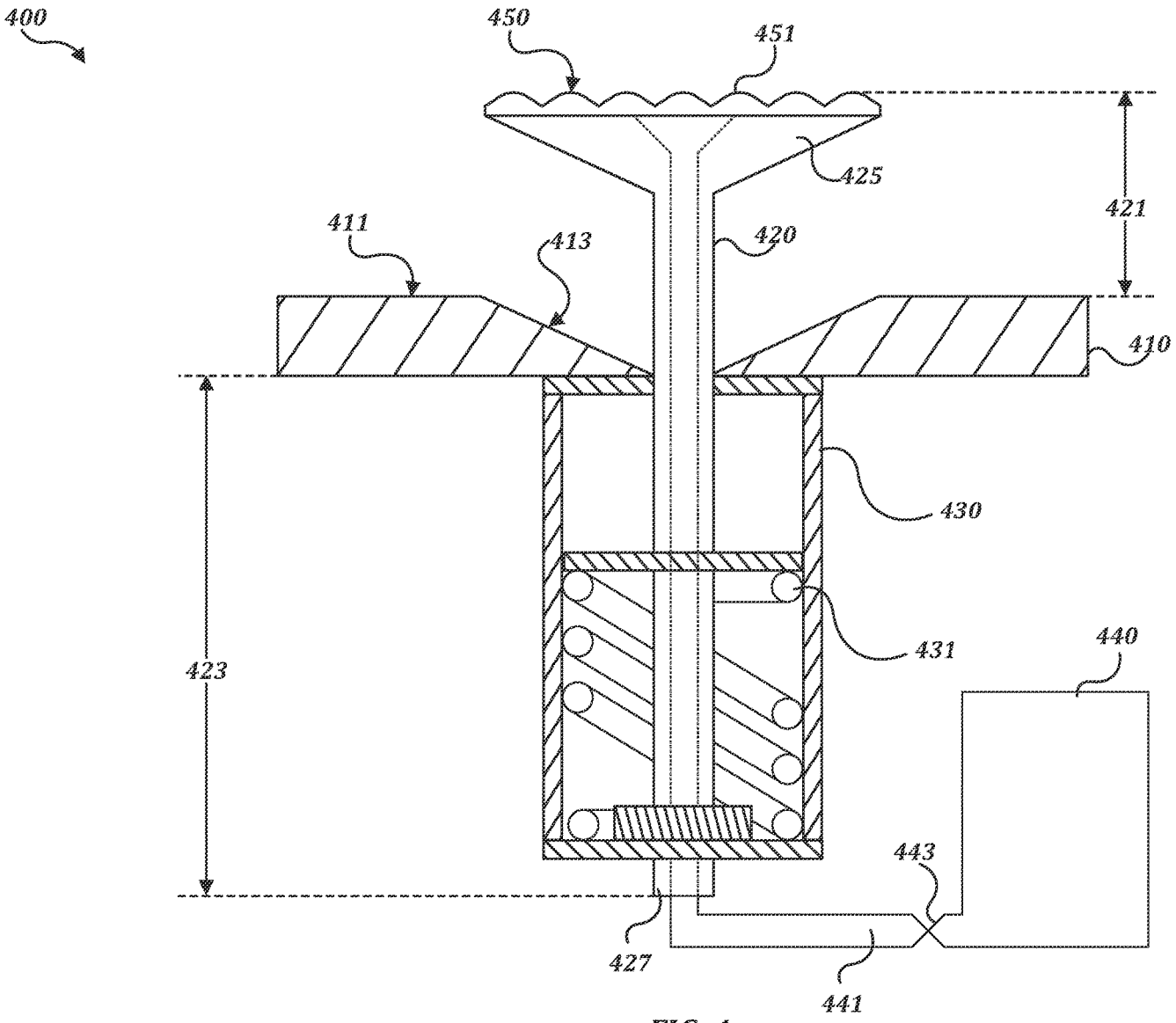
FIG. 4 is a schematic illustration of an example applicator element, in accordance with various embodiments.

FIG. 4 is a schematic illustration of an example applicator element 400, in accordance with various embodiments. The example applicator element 400 may be an example of the applicator elements 231 of FIG. 2, and/or applicator elements 331 of FIG. 3. The example applicator element 400 is disposed on a substrate 410, and includes an applicator member 420, a spring assembly 430, and a pigment reservoir 440. The example applicator element 400, with multiple additional applicator elements, may together define an applicator array (e.g., applicator array 111 of FIG. 1, applicator array 230 of FIG. 2, and/or applicator array 330 of FIG. 3).

The substrate 410 may be or include a rigid material that repels pigment, into and/or onto which the components of the example applicator element 400 may be disposed. For example, the substrate 410 may be or include a metal, glass, or plastic material to which a surface treatment may be applied to reduce the adsorption of pigment (e.g., pigment 237 of FIG. 2). The applicator member 420 may be or include a pin, rod, or other rigid element having a length substantially orthogonal to an outer surface 411 of the substrate 410. The applicator member 420 may extend into or through the substrate 410, defining a first portion 421 of the length extending from the outer surface of the substrate and a second portion 423 of the applicator member extending into or through the substrate 411, wherein the first portion 421 defines a first end 425 and the second portion 423 defines a second end 427 opposite the first end 425. In this way, the first end 425 may define an applicator surface 450. The applicator surface 450, in turn, may include a compliant material 451 disposed on the applicator surface 450. For example, the compliant material 451 may be or include ridged or otherwise textured or structured surface that conforms to a surface when pressure is applied. Additionally, the compliant material 451 may increase the volume of pigment that may be held by the applicator member 420 at the applicator surface 450, for example, by increasing the effective surface area of the applicator surface 450.

The applicator member 420 may widen at or toward the first end 425, for example, by tapering from the applicator surface 450. In this way, the example applicator element may be or include internal mechanisms, such as actuators, spring assemblies, EM sources, and/or pigment reservoirs, while also providing an applicator surface 450 suitable to hold enough pigment to transfer discernable design features onto a surface. It is noted that, in FIG. 4, the first end 425 is illustrated to demonstrate the concept of a wider first end 425 and is not intended to indicate the scale of the width increase. It is contemplated that the first end 425 may be the same width as the applicator member 420, slightly wider than the applicator member 420 (e.g., 5%, 10%, 15%, 20%, 25%, or more), or greatly wider (e.g., 50%, 60%, 70%, 80%, 100%, 200%, or more). The substrate 410 may include a recessed surface 413 complementary to the first end 425. In this way, the applicator member 420 may be recessed into the substrate 410, such that the applicator surface 450 may be approximately flush or level with the outer surface 411. In addition, the recessed surface 413 may serve to center the applicator member 420 and may protect the applicator member 420 between uses.

In some embodiments, the example applicator element 400 further includes a spring assembly 430. The spring assembly 430 may be mechanically coupled with the second portion 423 and/or the substrate 410 to oppose motion of the applicator surface 450 toward the outer surface 411. The spring assembly may include a spring 431 positioned such that motion of the applicator surface 450 toward the outer surface 411 compresses the spring and generates a reaction force pushing the applicator member 420 and the applicator surface 450 away from the outer surface 411 of the substrate 410. In an illustrative example, the applicator member 420 may include a collar, ridge, or pegs disposed on or formed from the applicator member 420. The collar may be mechanically coupled to the spring 431 and may cause the spring to compress and expand as the applicator member 420 moves relative to the spring assembly 430. In this way, the spring assembly 430 may permit the applicator member 420 to conform to a target surface, as described in more detail in reference to FIG. 5.

In some embodiments, the applicator array device also incorporates a pigment reservoir 440. The pigment reservoir 440 may be fluidly coupled with the applicator surface 421, for example, through one or more conduits 441. The conduit (s) 441 may include control elements, such as one or more valves 443 to controllably release pigment from the pigment reservoir 440 onto the porous material 430. Additionally and/or alternatively, the applicator array device 440 may incorporate or include multiple pigment reservoirs 440, as part of controllably providing pigment to one or more applicator elements of the applicator array.

In this way, the example applicator element 400 may saturate the compliant material 451 using a liquid pigment from the pigment reservoir 440. The applicator array device, provided with the pigment reservoir 440, may serve as both the applicator array device (e.g., applicator array device 110 of FIG. 1) and the pigment applicator (e.g., applicator array device 120 of FIG. 1.

In an illustrative example, the applicator array device may receive a cosmetic design from a client computing device (e.g., client computing device 130 of FIG. 1), may open the valve 443 corresponding to the example applicator element 400, may drive a volume of liquid pigment from the pigment reservoir 440 to be distributed onto the applicator surface 450, and may initialize the example array element 400 by repositioning the applicator member 420 into the position corresponding to a received cosmetic design.

Figure 5:
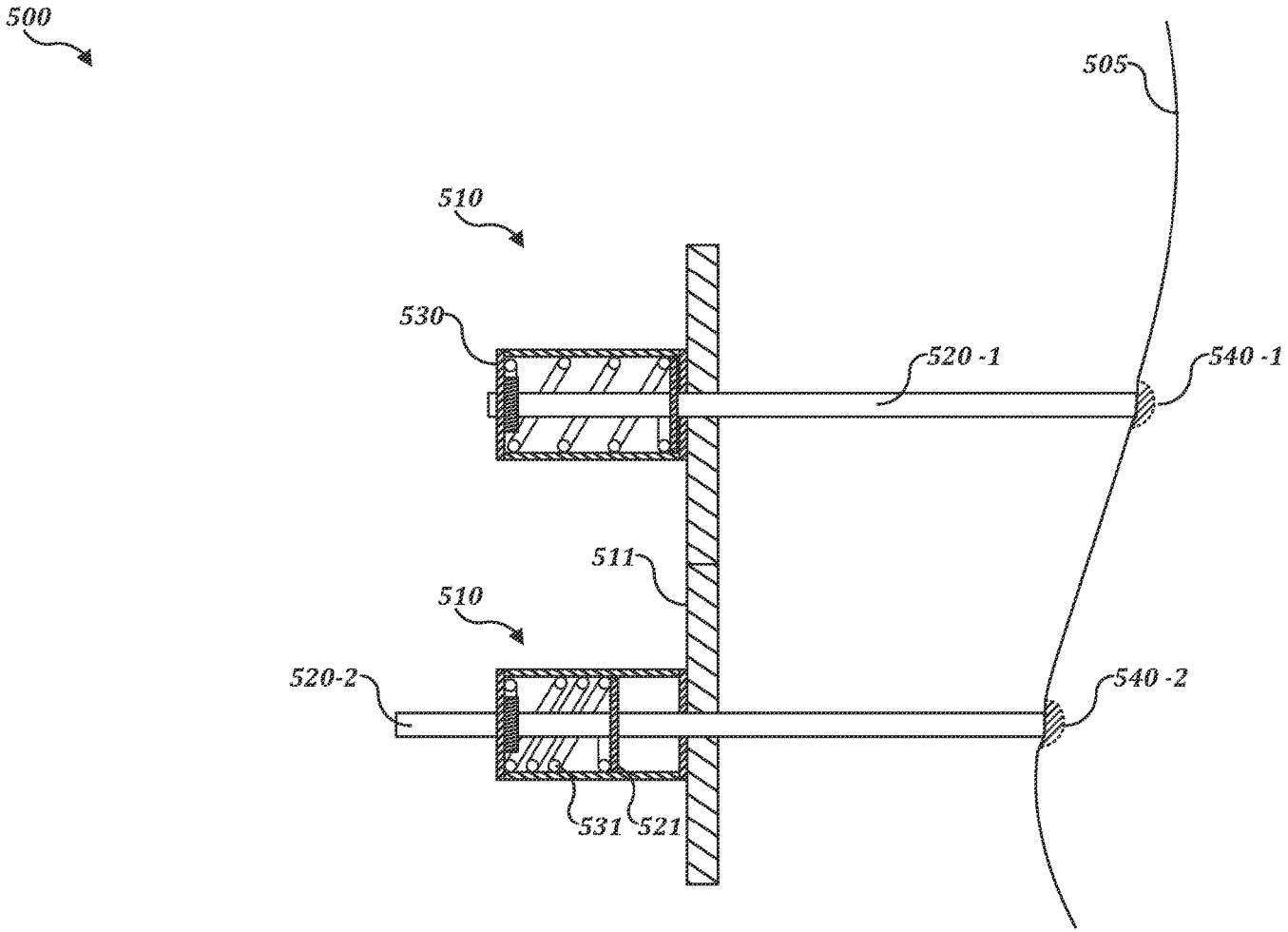
FIG. 5 is a schematic illustration of an example applicator array conforming to a biological subject, in accordance with various embodiments.

FIG. 5 is a schematic illustration of an example applicator array 500 conforming to a biological subject, in accordance with various embodiments. The example applicator array 500 may be an example of applicator array 111 of FIG. 1, applicator array 230 of FIG. 2, applicator array 330 of FIG. 3, and may be defined by multiple applicator elements 510, which may be examples of applicator elements 231 of FIG. 2, applicator elements 331 of FIG. 3, and/or example applicator element 400 of FIG. 4. The example applicator array 500 is illustrated conforming to a surface 505, which may be an example of the surface 211 of FIG. 2, to which a cosmetic design may be applied. The surface 505 may be a body surface of a biological subject (e.g., a human), as described in reference to FIG. 1. The applicator elements 510 may be disposed on or in a substrate 511, and may each include an applicator member 520 and a spring assembly 530 to oppose motion of the applicator member 520.

As described in reference to FIG. 4, the spring assembly 530 may include a spring 531, which may be mechanically coupled to the applicator member 520 via a collar 521, rib, pin, or other mechanical coupler. In this way, force applied to the applicator member 520 by the surface 505 may be transferred and stored in the spring 531. As illustrated, a first applicator member 520-1 is contacting the surface 505 at a first point 540-1, while a second applicator member 520-2 is contacting the surface 505 at a second point 540-2 that is nearer to the substrate 511 than first point 540-1. The applicator members 520 may be freely movable, slideable, and/or unfixed relative to the substrate 511, such that the second applicator member 520-2 may be free to move toward the substrate and conform to the surface 505. The motion may compress the spring 531 coupled to the second applicator member 520-2, such that contact with the first point 540-1 and the second point 540-2 may be maintained despite motion of the example applicator array 500 relative to the surface 505.

While the example applicator element 400 of FIG. 4 and the applicator elements 510 of FIG. 5 are illustrated with passive spring assembly components, it is contemplated that, in some embodiments, the applicator elements 510 may include or incorporate active components, such as electronic or mechanical actuators, that may actively reposition the applicator members 520 in accordance with a cosmetic design and/or a surface mapping of the surface 505. For example, applicator elements 510 may include spring-loaded linear motors permitting the first portion of each of the applicator elements 510 to be defined by the applicator array device. Similarly, actuators may include shape memory alloys, micromotors, electromagnetic coils, pneumatic circuits, or piezoelectric materials, as described in more detail in reference to FIGS. 6-8.

Figure 6:
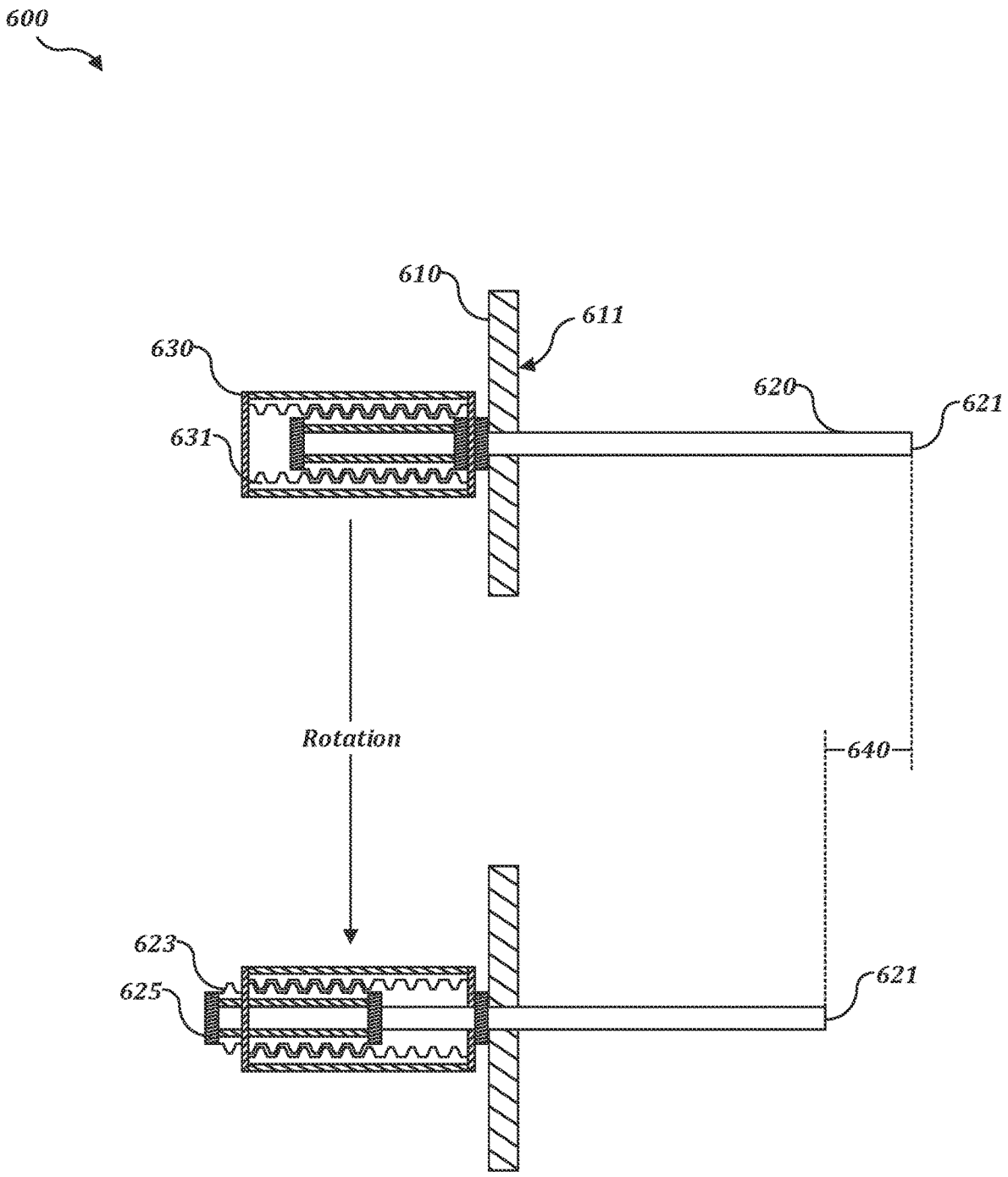
FIG. 6 is a schematic illustration of an example applicator element including a mechanical actuator, in accordance with various embodiments.

FIG. 6 is a schematic illustration of an example applicator element 600 including a mechanical actuator, in accordance with various embodiments. The example applicator element 600 may be an example of the applicator elements 231 of FIG. 2, applicator elements 331 of FIG. 3, example applicator element 400 of FIG. 4, and or applicator elements 510 of FIG. 5. The example applicator element 600 is disposed on or in a substrate 610 and includes an applicator member 620 and a mechanical actuator 630 mechanically coupled with the applicator member 620 and/or the substrate 610. The example applicator element 600, with multiple additional applicator elements similarly configured, may together define an applicator array (e.g., applicator array 111 of FIG. 1, applicator array 230 of FIG. 2, applicator array 330 of FIG. 3, and/or example applicator array 500 of FIG. 5).

The applicator member 620 may define a first end 621 that, through action of the mechanical actuator 630, may be repositioned relative to an outer surface 611 of the substrate 610 as part of mapping the example applicator element 600 to a surface mapping as described in more detail in reference to FIG. 2. In an illustrative example, the mechanical actuator 630 may be or include an electric motor coupled to a linear drive, illustrated as a lipstick-type linear translator, to reposition the first end 621 of the applicator member 620 in a linear manner toward or away from the outer surface 611. In this example, the mechanical actuator 630 includes a helical screw 631 paired with one or more corresponding helical edges 623 mechanically coupled to the applicator member 620. By rotating the mechanical actuator 630, for example, while holding the applicator member 620 rotationally static, the applicator member 620 may be translated linearly over a distance 640. In an illustrative example, the applicator member 620 may be held rotationally static by a retaining member 625 that permits the applicator member 620 to translate linearly without rotating with the mechanical actuator 630.

Figure 7:
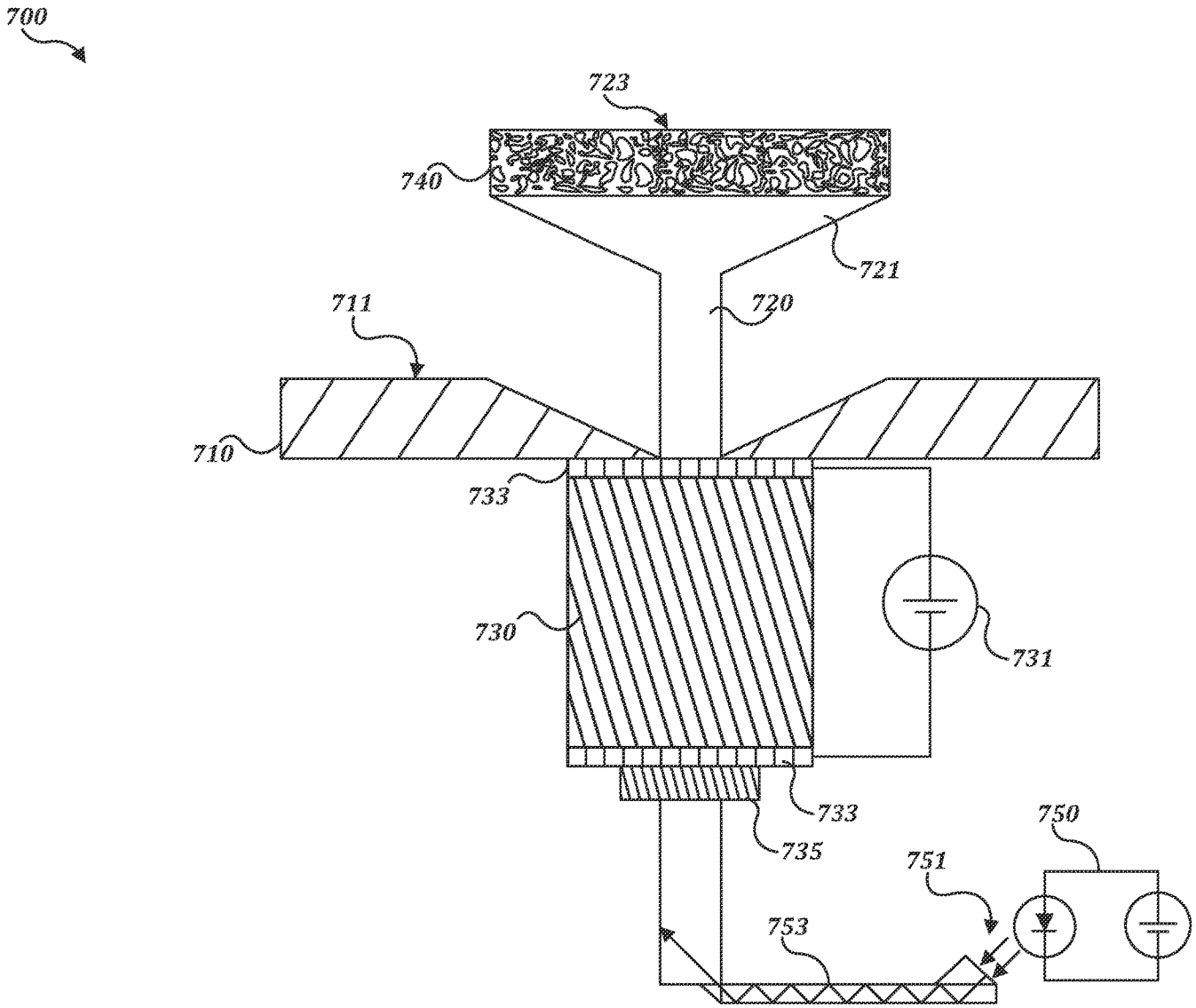
FIG. 7 is a schematic illustration of an example applicator element including an electronic actuator, a porous material, and a source of electromagnetic radiation, in accordance with various embodiments.

FIG. 7 is a schematic illustration of an example applicator element 700 including an electronic actuator 730, a porous material 740, and a source of electromagnetic radiation 750 (referred to as EM source 750), in accordance with various embodiments. The example applicator element 700 may be an example of the applicator elements 231 of FIG. 2, applicator elements 331 of FIG. 3, applicator element 400 of FIG. 4, applicator elements 510 of FIG. 5, and/or applicator elements 610 of FIG. 6. As illustrated, the electronic actuator 730 includes electrical components to actuate an applicator member 720 relative to a substrate 710. For example, a first end 721 of the applicator member 720 may be repositioned relative to an outer surface 711 of the substrate 710 as part of implementing a cosmetic design, as described in more detail in reference to FIGS. 1-3. The electronic actuator 730 may be or include components including, but not limited to, a voltage source 731 such as a direct current source, a rectified alternating current source, a pulsed direct current source, and/or an alternating current source. The voltage source 731 may be electrically coupled with the electronic actuator 730 via one or more contacts 733. The electronic actuator 730 may be mechanically coupled with the applicator member 720 via a collar 735, union, locking mechanism, or other physical coupling such that expansion and contraction of the electronic actuator 730 may be transferred to the applicator member 720 as an approach to repositioning the first end 721 relative to the outer surface 711.

In some embodiments, the electronic actuator 730 may be or include a shape memory alloy, an electromagnetic coil, a pneumatic circuit, or a piezoelectric material. Where a shape memory alloy is used, the voltage source 731 and electrical contacts 733 may be implemented with a thermal control circuit to controllably heat the shape memory alloy, to thereby cause expansion or a contraction of the electronic actuator 730. Where a piezoelectric material is used, expansion of the piezoelectric material results from direct application of a voltage across the ceramic. Where an electromagnetic coil is used, one or more magnets, electromagnets, or ferromagnetic materials may be disposed in or on the applicator member 720, such that an electric field induced by current through the coil may induce a force on the applicator member 720 and cause motion relative to the substrate 710. Where a pneumatic circuit is used, electronic control circuitry may controllably fill and/or empty a pneumatic piston mechanically coupled with the applicator member 720 (e.g., via the collar 735) to reposition the first end 721 relative to the outer surface 711.

In some embodiments, the applicator surface 720 of the example applicator element 700 includes a compliant material disposed on at least a portion of the applicator surface 720. For example, the compliant material may be or include a porous material 740 that may be disposed at the first end 721 to define an applicator surface 723. In addition to providing a conformable contact between the first end 721 and a target body surface for the example applicator element 700, the porous material 740 may also serve as a reservoir of pigment at the first end 721 that increases the pigment capacity of the applicator surface 723.

As described in more detail in reference to FIG. 3, the pigment applied to at least a portion of the applicator array may be or include a bistable photo-switched material. To modulate the phase of the bistable pigment, the example applicator element 700 includes the EM source 750. The EM source 750 may be or include, but is not limited to, a light-emitting diode, diode laser, or other line source. EM radiation 751 emitted by the EM source 750 may be coupled into the applicator member 720 via a waveguide 753, for example, by internal reflection, such that the switching wavelength may be conducted to the first end 721. As described in more detail in reference to FIG. 3, phase-switching of the bistable material may be effected by a photo-initiated chemical reaction. In this way, where the applicator member 720 is shown with the porous material 740 at the applicator 723, the chemical reaction may be initiated at the boundary between the applicator member 720 and the porous material 740 within which the EM radiation 751 may be absorbed. While the example applicator element 700 is illustrated showing the EM radiation 751 being coupled into the applicator element 720, the waveguide 753 may extend through the substrate 710 and emit the EM radiation 751 at or near the porous material 740 directly.

Figure 8A:
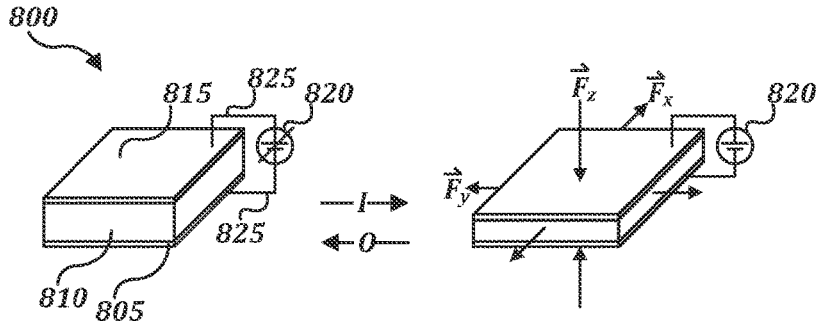
FIG. 8A is a schematic illustration of an example electroactive polymer cell, in accordance with various embodiments.

FIG. 8A is a schematic illustration of an example electroactive polymer cell 800, in accordance with various embodiments. The example electroactive polymer cell 800 includes a first electrode 805, an electroactive polymer layer 810, a second electrode 815, and a voltage source 820. The voltage source 820 may be electrically coupled with the first electrode 805 and the second electrode 825 via conductive traces 825. The conductive traces 825 may be or include at least a portion being a flexible material. In some cases, the conductive traces 825 may be or include flexible conductors, including but not limited to flexible/stretchable carbon conductors, silver conductors, or copper conductors. In an illustrative example, the carbon conductors may be or include conductive carbon materials (e.g., carbon fibers, nanotubes, graphene, or the like) suspended in a monomer or polymer matrix. Similarly, the silver or copper conductors may be or include conductive materials (e.g., nanorods, nanoparticles, or the like) suspended in a matrix. The conductors may be screen-printed, evaporation-deposited, or otherwise patterned onto the substrate 860 to form the electrode traces 871 and 881.

The example electroactive polymer cell 800 may be described by two different morphologies corresponding to whether the voltage source 820 applies a voltage across the electroactive polymer layer 810. As illustrated in FIG. 8A, when the voltage source 820 is open or shorted, such that no voltage is applied across the electroactive polymer layer 810, the example electroactive polymer cell 800 may assume a first morphology. In response to closing the circuit, thereby applying the voltage across the electroactive polymer layer 810, the example electroactive polymer cell 800 may shift to a second morphology, as a result of forces ($F_x$, $F_y$, $F_z$) generated by changes in the polymer structure. While the forces are described in reference to cartesian axes, the example electroactive polymer cell 800 may be a cylindrical cell or may assume other shapes, such that alternative coordinate spaces may better describe the forces generated following application of the voltage to the example electroactive polymer cell 800.

In some embodiments, the electroactive polymer layer 810 may be or include, but is not limited to, materials such as conducting polymers, dielectric elastomers, ferroelectric polymers, ionic polymer metal composite (IPMC), or polyvinylidene difluoride (PVDF). Material selection may be informed by different electronic and structural properties. For example, conductive polymers and IPMC may respond to a relatively lower activation voltage, as compared to PVDF, dielectric elastomers, or ferroelectric polymers, while dielectric elastomer, ferroelectric, and/or PVDF may generate a relatively stronger actuation force at a relatively higher voltage.

The magnitude of the voltage may be influenced by the chemical structure and/or the physical dimensions of the electroactive polymer layer 810. In some cases, a higher voltage may provide a greater movement or greater force upon application, but may also introduce electromagnetic interference effects in the applicator array device, such as corona discharge formation. Such concerns may increase the complexity of the electronic components of the applicator array device, and may reduce performance. In this way, the example electroactive polymer cell 800 may be configured to apply the voltage to induce an effective change in morphology, without also introducing negative effects. In some embodiments, the voltage is about 10 kV or less, about 9 kV or less, about 8 kV or less, about 7 kV or less, about 6 kV or less, about 5 kV or less, about 4 kV or less, about 3 kV or less, about 2 kV or less, about 1 kV or less, about 0.9 kV or less, about 0.8 kV or less, about 0.7 kV or less, about 0.6 kV or less, about 0.5 kV or less, about 0.4 kV or less, about 0.3 kV or less, about 0.2 kV or less, about 0.1 kV or less, or less, including fractions and interpolations thereof. For example, the voltage may be about 5.9 kV or less, about 5.8 kV or less, about 5.7 kV or less, about 5.6 kV or less, about 5.5 kV or less, about 5.4 kV or less, about 5.3 kV or less, about 5.2 kV or less, or about 5.1 kV or less. In this context, "about" is used to refer to a value within 10% of the stated value (e.g., from 90% to 110% of the stated value).

Figure 8B:
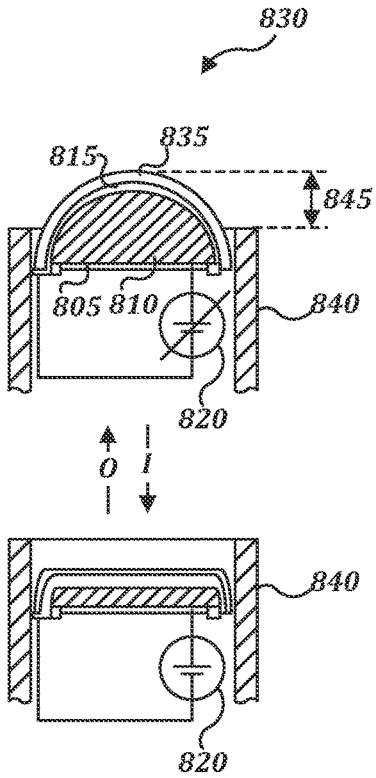
FIG. 8B is a schematic illustration of an example applicator element including an electroactive polymer actuator, in accordance with various embodiments.

FIG. 8B is a schematic illustration of an example applicator element 830 including an electroactive polymer actuator, in accordance with various embodiments. The applicator member may include circuitry and/or components to incorporate adaptive surfaces at one or more positions of the example applicator element 830. For example, an electroactive polymer actuator, as described in reference to FIG. 8A, may be integrated at or near the first end of the applicator member 840 of the applicator element 830. The electroactive polymer actuator may include a first electrode 805, an electroactive polymer layer 810 electronically coupled with the first electrode 805, and a second electrode 815, electronically coupled with the electroactive polymer layer 810. In this way, the electroactive polymer actuator may switch between a first position and a second position in accordance with an applied voltage to the electroactive polymer layer 810. As with the example electroactive polymer cell 800 of FIG. 8A, the applied voltage may be supplied by a voltage source 820 which may be integrated into the applicator array device. For example, the voltage source 820 may be or include an energy storage device (e.g., a battery) or other source of electrical energy, control circuitry, and conductive traces to controllably couple the first electrode 805 and the second electrode 815 to the voltage source 820.

In some embodiments, the example applicator element 830 includes a flexible layer overlying the electroactive polymer actuator and defining the applicator surface 835. Consistent with the switch between first and second positions in accordance with applicator and removal of the applied voltage, the applicator surface 835 may be recessed within the example applicator element 830 when the electroactive polymer actuator is in the first position. Conversely, the applicator surface 835 may extend proud of the first end of the applicator member 840 when the electroactive polymer actuator is in the second position.

In some embodiments, the example applicator element 830 may include multiple electroactive polymer layers 810, interleaved with multiple first electrodes 805 and multiple second electrodes 815. In this way, the applicator surface 835 may be raised and lowered by a displacement 845 that describes the sum of the changes in morphology for each of the constituent electroactive polymer layers 810. In terms of the cosmetic design (e.g., cosmetic design 210 of FIG. 2) increasing the displacement 845 may improve the precision, contrast, and fidelity of application of the cosmetic design. For example, when recessed within the first end of the applicator member 840, the applicator surface 835 may form a cavity to retain a small volume of pigment. Extending the applicator surface 835 proud of the first end of the applicator member 840, therefore, may apply the reserved pigment within the boundary of the example applicator element 830, once the example applicator element 830 is at a stable position. Additionally, expanding the applicator surface 835 by switching the electroactive polymer layer 810 may permit the applicator surface 835 to fill spaces between the first end of the applicator member 840 and a target body surface, for example, where the first end of the applicator member 840 approaches the surface at a non-orthogonal angle.

In some embodiments, the displacement 845 may be about 0.1 mm or greater, about 0.2 mm or greater, about 0.3 mm or greater, about 0.4 mm or greater, about 0.5 mm or greater, about 0.6 mm or greater, about 0.7 mm or greater, about 0.8 mm or greater, about 0.9 mm or greater, about 1.0 mm or greater, about 1.5 mm or greater, about 2.0 mm or greater, about 2.5 mm or greater, about 3.0 mm or greater, about 3.5 mm or greater, about 4.0 mm or greater, about 4.5 mm or greater, about 5.0 mm or greater, about 5.5 mm or greater, about 6.0 mm or greater, about 6.5 mm or greater, about 7.0 mm or greater, about 7.5 mm or greater, about 8.0 mm or greater, about 8.5 mm or greater, about 9.0 mm or greater, about 9.5 mm or greater, or about 10.0 mm or greater, including fractions and interpolations thereof (e.g., 1.3 mm, 3.7 mm, 5.1 mm, etc.). In this context, the term "about" is used to refer to a value within 10% of the stated value.

Figure 8C:
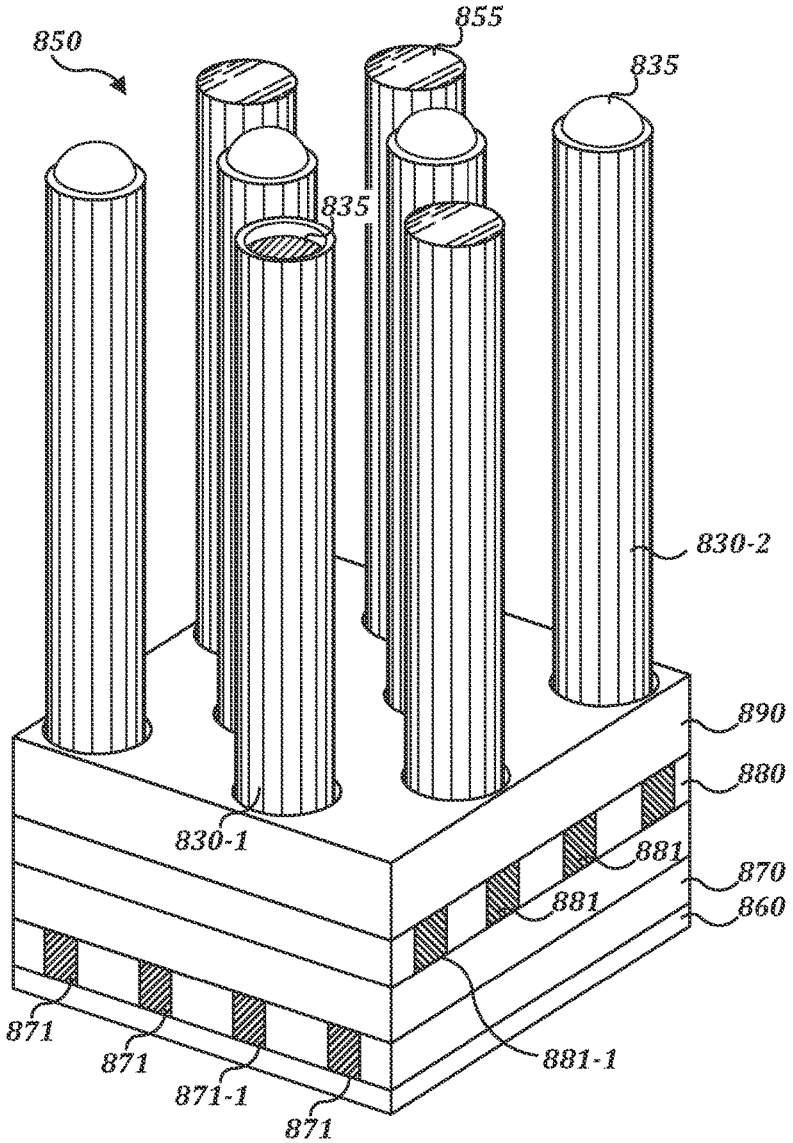
FIG. 8C is a schematic illustration of an example applicator array including electroactive polymer actuator tips, in accordance with various embodiments.

FIG. 8C is a schematic illustration of an example applicator array 850 including electroactive polymer actuator tips, in accordance with various embodiments. The example applicator array 850 may be an example of applicator array 111 of FIG. 1, applicator array 230 of FIG. 2, and/or applicator array 330 of FIG. 3. The example applicator array 850 may be integrated into an applicator array device, such as applicator array device 110 of FIG. 1, and may be actuated to apply a cosmetic design to a target body surface, as described in more detail in reference to FIGS. 1-7. The example applicator array 850 is illustrated as a multilayer electronic device incorporating a substrate 860, a first electrode layer 870, a second electrode layer 880, and an outer surface layer 890. In some embodiments, the example applicator array 850 includes additional and/or alternative elements in various configurations. The substrate 860, the first electrode layer 870, the second electrode layer 880, and the outer surface layer 890 may be discretized or differentiated into individual applicator elements 830 that together define the example applicator array 850. For example, the example applicator array 850 may include separate first electrodes 871 for each applicator element 830, and a common second electrode layer 880 for each applicator element 830, where the second electrode layer 880 serves as a relative ground. While the example applicator array 850 is illustrated as a square matrix of applicator elements 830, other polygonal array configurations are contemplated including, but not limited to, hexagonal arrays, rectangular arrays, circular arrays, triangular arrays, or the like. Similarly, while the applicator elements 830 are illustrated as circular, other shapes are contemplated including, but not limited to, triangular, square, rectangular, pentagonal, hexagonal, octagonal, ellipsoidal, or oblong.

In an illustrative example, a first applicator element 830-1 of the applicator elements 830 may be individually addressed by completing a circuit between the first electrode layer 870 and the second electrode layer 880, via an electroactive polymer layer 810 located at a first end 855 of the first applicator element 830-1. In this way, the applicator surface 835 of the first applicator element 830-1 may be retracted into the applicator member 840, as shown, while a neighboring second applicator element 830-2 may retain a raised position of the applicator surface 835.

In some embodiments, the circuits described may be formed by paired conductive traces, between one of multiple first electrode traces 871 and one of multiple second electrode traces 881. For example, a circuit may be closed or opened, depending on the internal configuration of the first applicator element 830-1, between a first trace 871-1 of the first electrode traces 871 and a first trace 881-1 of the second electrode traces 881. In this way, the applicator elements 830 may be individually addressable by controllably closing circuits between the electrode traces of the example applicator array 850. In some embodiments, each applicator element 830 is individually coupled with a control switch that is operably coupled with a controller to open and close the circuit for the respective applicator element 830. In this way, the applicator surfaces 835 may be raised or lowered in accordance with a cosmetic design.

The applicator surface 835 may be or include a flexible polymeric or rubber material. The applicator surface 835 may define an applicator tip for each of the applicator elements 830. While the applicator elements 830 are illustrated as substantially flat, the applicator surface 835 may be formed with topography on each of the applicator elements. For example, the applicator tips may be ridged, concave, convex, pyramidal, hemi-spherical, or the like, such that the volume of pigment and application of pigment to the surface may be metered and/or controlled by modulating the pressure applied between the applicator elements 830 and the target surface. Advantageously, implementing the example applicator array 850 with electroactive polymer actuators and a flexible material applicator surface 835 may improve the ability of the example applicator array 850 to conform to the target body surface, to fill voids between the first end 855 and the target body surface, or to controllably apply pigment within the internal space of the applicator members 830.

Figure 9:
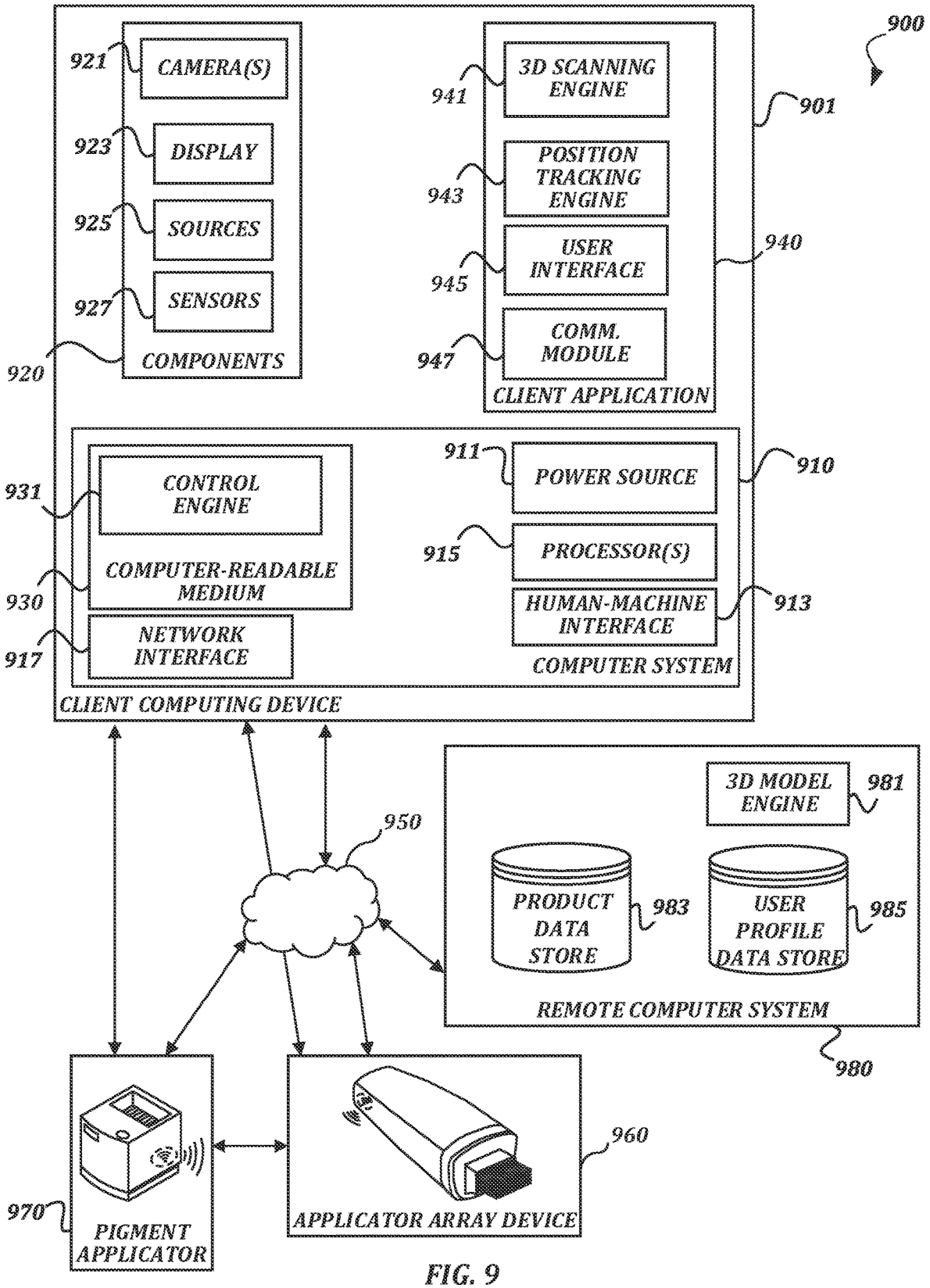
FIG. 9 is a block diagram that illustrates an example system, including components of the system of FIG. 1, in accordance with various embodiments.

FIG. 9 is a block diagram that illustrates an example system 900, including components of the system of FIG. 1, in accordance with various embodiments. The example system 900 may include a client computing device 901 in electronic communication (e.g., over a network 950) with an applicator array device 960, a pigment applicator 970, and a remote computer system 980. Example system 900 illustrates an example of the system 100 of FIG. 1, in a context of associated system elements, and, as such, describes electronics and software executing operations as described in reference to FIGS. 2-3. FIG. 9 depicts a non-limiting example of system elements, features and configurations; many other features and configurations are contemplated. In the example shown in FIG. 9, the client computing device 901 (e.g., client computing device 104 of FIG. 1) includes a computer system 910, multiple components 920 for interacting with the user and for generating cosmetic designs and for facilitating application of the cosmetic design onto a target surface (e.g., surface 211 of FIG. 2), a computer-readable medium 930, and a client application 940, that may be stored as computer-executable instructions on the computer-readable medium 930, and, when executed by the computer system 910, may implement the operations described in reference to the system 90 of FIG. 1, and the operations of the example techniques of FIGS. 2-3.

The client computing device 901 incorporates subcomponents including, but not limited to, a power source 911, a human-machine interface 913, one or more processors 915, a network interface 917, and may include the computer-readable medium 930. The power source 911 is a direct-current power source, for example, a rechargeable battery or a rectified power supply configured to connect to line-power (e.g., 110 VAC, 220 VAC, etc.). The human-machine interface (HMI) 913 may include any type of device capable of receiving user input or generating output for presentation to a user, such as a speaker for audio output, a microphone for receiving audio commands, a push-button switch, a toggle switch, a capacitive switch, a rotary switch, a slide switch, a rocker switch, or a touch screen.

The one or more processors 915 are configured to execute computer-executable instructions stored on the computer-readable medium 930. In an embodiment, the processor(s) 915 are configured to receive and transmit signals to and/or from the components 920 via a communication bus or other circuitry, for example, as part of executing the client application 940. The network interface 917 is configured to transmit and receive signals to and from the client computing device 901 (or other computing devices) on behalf of the processors 915. The network interface 917 may implement any suitable communication technology, including but not limited to short-range wireless technologies such as Bluetooth, infrared, near-field communication, and Wi-Fi; long-range wireless technologies such as WiMAX, 2G, 3G, 4G, LTE, and 10G; and wired technologies such as USB, FireWire, Thunderbolt, and/or Ethernet. The computer-readable medium 930 is any type of computer-readable medium on which computer-executable instructions may be stored, including but not limited to a flash memory (SSD), a ROM, an EPROM, an EEPROM, and an FPGA. The computer-readable medium 930 and the processor(s) 915 may be combined into a single device, such as an ASIC, or the computer-readable medium 930 may include a cache memory, a register, or another component of the processor 915.

In the illustrated embodiment, the computer-readable medium 930 has computer-executable instructions stored thereon that, in response to execution by one or more processors 915, cause the client computing device 901 to implement a control engine 931. The control engine 931 controls one or more aspects of the client computing device 901, as described above. In some embodiments, the computer-executable instructions are configured to cause the client computing device 901 to perform one or more operations such as generating a surface mapping of the target surface, generating a cosmetic design, or providing the cosmetic design to an applicator array device 960 and/or a pigment applicator 970. In some embodiments, the control engine 931 controls basic functions by facilitating interaction between the computer system 910 and the components 920 according to the client application 940. In some embodiments, the control engine 931 detects input from HMI 913 indicating that a cosmetic routine is to be initiated (e.g., in response to activation of a power switch or "start" button, or detection of a face in front of the mirror 96 of FIG. 1), or receives signals from the applicator array device 960, the pigment applicator 970, or the remote computer system 980 (e.g., over a Bluetooth paired connection).

The components of the client computing device 901 may be adapted to the application or may be specific to the application of configuring applicator array devices to apply cosmetic designs. For example, the components 920 may include one or more cameras 921, a display 923, one or more illumination sources 925, and/or one or more sensors 927, as described in more detail in reference to FIG. 1. In some embodiments, the components 920 are integrated into a single device such that the client computing device 901 or at least of portion of the elements of the client computing device 901 take on the appearance of a unitary cosmetic device. In this way, the client computing device 901 may be a specialized computing device, configured to execute the client application 940 in coordination with the components 920.

In some embodiments, the client application 940 also includes an image capture/3D scanning engine 941 configured to capture and process digital images (e.g., color images, infrared images, depth images, etc.) obtained from one or more of the components 920 including but not limited to stereoscopic images, LiDAR data, or other forms of surface/depth sensing information. In some embodiments, such data are used to obtain a clean and precise 3D contour mapping of the target body surface (e.g., target surface 181 of FIG. 1). In some embodiments, the digital images or scans are processed by the client computing device 901 and/or transmitted to the remote computer system 980 for processing in a 3D model engine 981. In an embodiment, captured image data is used in position tracking engine 943 for determining the position of features, key-points, or edges on the target body surface. In some embodiments, the position tracking engine 943 tracks the contours of the target body surface in a 3D space, for example, by implementing v-SLAM techniques. In some embodiments, position information from the position tracking engine 943 is used to generate signals to be transmitted to the control engine 931, which are used to control one or more components 920 or elements of the computer system 910 including, for example, the sources 925 or the HMI 913, according to techniques described herein.

In some embodiments, digital 3D models described herein are generated based on sensor data obtained the client computing device 901. As such, the digital 3D models are generated by the client computing device 901 or some other computing device, such as a remote cloud computing system, or a combination thereof. In some embodiments, the digital 3D models include 3D topology and texture information, which can be used for reproducing an accurate representation of a body surface, such as facial structure and skin features, as described in more detail in reference to FIGS. 1-2.

In some embodiments, the client application 940 includes a user interface 945. In an embodiment, the user interface 945 includes interactive functionality including but not limited to graphical guides or prompts, presented via the display to assist a user in selecting cosmetic designs, tutorial videos, or animations. Visual elements of the user interface 945 also may be presented via a display of the applicator array device 960 and/or the pigment applicator 970. In some embodiments, the user interface 945 provides guidance (e.g., visual guides such as arrows or targets, progress indicators, audio/haptic feedback, synthesized speech, etc.) to guide a user under particular lighting conditions, angles, etc., in order to ensure that sufficient data is collected for use by mapping and projection engines.

The client application 940 may include a source steering module 947. The source steering module 947 may be or include computer-readable instructions (e.g., software, drivers, etc.) for translating a numerical representation of an exposure pattern into intensity and direction data to drive the sources 925. For example, while the control engine 931 may service communication between the various components of the client computing device 901, specific drive signals may be generated by the source steering module 947. As part of the operation of the source steering module 947, the client application may receive real-time data from the camera(s) 921 and sensors 927, which may be processed by the 3D scanning engine 941, the position tracking engine 943, and may be used to progressively update the mapping and the cosmetic design. In this way, the source steering module 947 may respond to motion of the target body surface, thereby increasing the tolerance of the client computing device 901 for motion on the part of the user without loss of fidelity to the cosmetic design. In some embodiments, the computational resource demand for such real time scanning/tracking, may be spread across multiple devices, such as the applicator array device 960, the pigment applicator 970, and/or the remote computer system 980, through parallelization or distribution routines.

A communication module 947 of the client application 940 may be used to prepare information for transmission to, or to receive and interpret information from other devices or systems, such as the applicator array device 960, the pigment applicator 970, and/or the remote computer system 980, As described in more detail in reference to FIG. 1. Such information may include captured digital images, scans, or video, personal care device settings, custom care routines, user preferences, user identifiers, device identifiers, or the like. In an embodiment, the client computing device 901 collects data describing execution of care routines, image data of body surfaces, or other data. In an embodiment, such data is transmitted via the network interface 917 to the remote computer system 980 for further processing or storage (e.g., in a product data store 983 or user profile data store 985). The client computing device 901 may be used by a consumer, personal care professional, or some other entity to interact with other components of the system 900, such as the applicator array device 960, the pigment applicator 970, and/or the remote computer system 980. In an embodiment, the client computing device 901 is a mobile computing device such as a smartphone or a tablet computing device equipped with the components 920 and the client application 940 or provided with the components through electronic coupling with a peripheral device.

Illustrative components and functionality of the remote computer system 980 will now be described. The remote computer system 980 includes one or more server computers that implement one or more of the illustrated components, e.g., in a cloud computing arrangement. The remote computer system 980 includes a projection engine 987, the 3D model engine 981, the product data store 983, and the user profile data store 985. In an embodiment, the 3D model engine 981 uses image data (e.g., color image data, infrared image data) and depth data to generate a 3D model of the target body surface. The image data is obtained from the client computing device 901, for example, from the camera (s) 921 or the sensor(s) 927 that are integrated with or otherwise electronically coupled with client computing device 901. In an embodiment, image data and depth data associated with a user is stored in the user profile data store 985. In an embodiment, user consent is obtained prior to storing any information that is private to a user or can be used to identify a user.

In an embodiment, the mapping/projection engine 987 performs processing of data relating to a cosmetic routine, such as generating mappings of target surfaces using image/sensor data and/or generating a projection of the cosmetic designs routine, which can then be transmitted to the client computing device 901. The cosmetic routine information may include, for example, programmatic exposure pattern instructions for illuminating the target body surface that may be provided as instructions to be executed by the control engine 931, by the client application 940, or by the sources 925 directly.

In some embodiments, the projection engine 987 generates cosmetic design data using user information from the user profile data store 985, the product data store 983, the 3D model engine 981, or some other source or combination of sources. The 3D model engine 981 may employ machine learning or artificial intelligence techniques (e.g., template matching, feature extraction and matching, classification, artificial neural networks, deep learning architectures, genetic algorithms, or the like). For example, to generate the cosmetic design in accordance with a surface mapping of a face, the projection engine 987 may analyze a facial mapping generated by the 3D model engine 981 to measure or map contours, wrinkles, skin texture, etc., of the target body surface. The projection engine 987 may receive data describing a cosmetic design based on an identifier code provided by the user through the applicator array device 960, the pigment applicator 970, and/or directly from the client computing device 901. In such a scenario, the projection engine 987 may use such information to generate a projection of the cosmetic design (e.g., cosmetic design 210 of FIG. 2) or registration marks for the design onto the target body surface.

The devices shown in FIG. 9 may communicate with each other via a network 950, which may include any suitable communication technology including but not limited to wired technologies such as DSL, Ethernet, fiber optic, USB, Firewire, Thunderbolt; wireless technologies such as WiFi, WiMAX, 3G, 4G, LTE, 5G, 10G, and Bluetooth; and private networks (e.g., an intranet) or public networks (e.g., the Internet). In general, communication between computing devices or components of FIG. 9, or other components or computing devices used in accordance with described embodiments, occur directly or through intermediate components or devices.

Many alternatives to the arrangements disclosed and described with reference to FIGS. 1 and 9, are possible. For example, functionality described as being implemented in multiple components may instead be consolidated into a single component, or functionality described as being implemented in a single component may be implemented in multiple illustrated components, or in other components that are not shown in FIG. 1 or 9. As another example, devices in FIGS. 1 and 9 that are illustrated as including particular components may instead include more components, fewer components, or different components without departing from the scope of described embodiments. As another example, functionality that is described as being performed by a particular device or subcomponent may instead be performed by one or more other devices within a system. As an example, the 3D model engine 914 may be implemented in client computing device 901 or in some other device or combination of devices.

In addition to the technical benefits of described embodiments that are described elsewhere herein, numerous other technical benefits are achieved in some embodiments. For example, the system 900 allows some aspects of the process to be conducted independently by personal care devices or client computing devices, while moving other processing burdens to the remote computer system 910 (which may be a relatively high-powered and reliable computing system), thus improving performance and preserving battery life for functionality provided by personal care devices or client computing devices.

In general, the word "engine," as used herein, refers to logic embodied in hardware or software instructions written in a programming language, such as C, C++, COBOL, JAVA™ PHP, Perl, HTML, CSS, JavaScript, VBScript, ASPX, Microsoft .NET™, and/or the like. An engine may be compiled into executable programs or written in interpreted programming languages. Software engines may be callable from other engines or from themselves. Generally, the engines described herein refer to logical modules that can be merged with other engines or divided into sub-engines. The engines can be stored in any type of computer-readable medium or computer storage device and be stored on and executed by one or more general purpose computers, thus creating a special purpose computer configured to provide the engine or the functionality thereof.

As understood by one of ordinary skill in the art, a "data store" as described herein may be any suitable device configured to store data for access by a computing device. One example of a data store is a highly reliable, high-speed relational database management system (DBMS) executing on one or more computing devices and accessible over a high-speed network. Another example of a data store is a key-value store. However, any other suitable storage technique and/or device capable of quickly and reliably providing the stored data in response to queries may be used, and the computing device may be accessible locally instead of over a network, or may be provided as a cloud-based service. A data store may also include data stored in an organized manner on a computer-readable storage medium, as described further below. One of ordinary skill in the art will recognize that separate data stores described herein may be combined into a single data store, and/or a single data store described herein may be separated into multiple data stores, without departing from the scope of the present disclosure.

Figure 10:
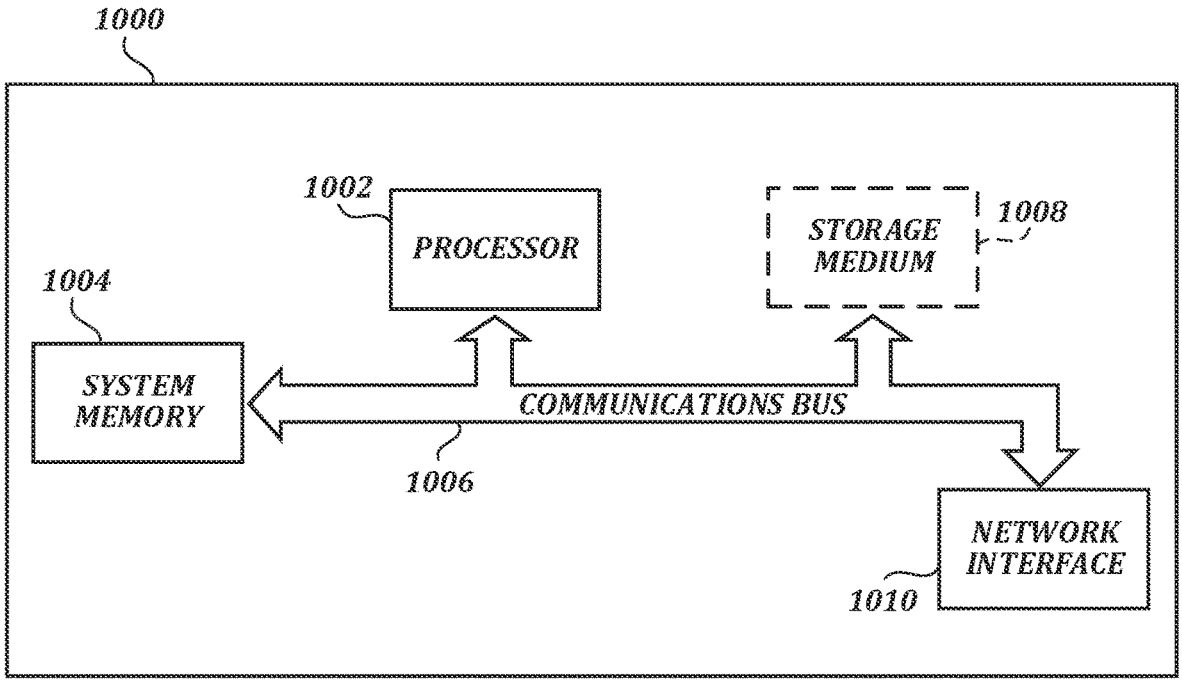
FIG. 10 is a block diagram that illustrates aspects of an example computing device, in accordance with various embodiments.

FIG. 10 is a block diagram that illustrates aspects of an example computing device 1000, in accordance with various embodiments. While multiple different types of computing devices are described in reference to the various embodiments, the example computing device 1000 describes various elements that are common to many different types of computing devices. While FIG. 10 is described with reference to a computing device that is implemented as a device on a network, the description below is applicable to servers, personal computers, mobile phones, smart phones, tablet computers, embedded computing devices, and other devices that may be used to implement portions of embodiments of the present disclosure. Moreover, those of ordinary skill in the art and others will recognize that the computing device 1000 may be any one of any number of currently available or yet to be developed devices.

In its most basic configuration, the example computing device 1000 includes at least one processor 1002 and a system memory 1004 connected by a communication bus 1006. Depending on the exact configuration and type of device, the system memory 1004 may be volatile or non-volatile memory, such as read only memory ("ROM"), random access memory ("RAM"), EEPROM, flash memory, or similar memory technology. Those of ordinary skill in the art and others will recognize that system memory 1004 typically stores data and/or program modules that are immediately accessible to and/or currently being operated on by the processor 1002. In this regard, the processor 1002 may serve as a computational center of the computing device 1000 by supporting the execution of instructions.

As further illustrated in FIG. 10, the computing device 1000 may include a network interface 1010 comprising one or more components for communicating with other devices over a network. Embodiments of the present disclosure may access basic services that utilize the network interface 1010 to perform communications using common network protocols. The network interface 1010 may also include a wireless network interface configured to communicate via one or more wireless communication protocols, such as WiFi, 2G, 3G, LTE, WiMAX, Bluetooth, Bluetooth low energy, and/or the like. As will be appreciated by one of ordinary skill in the art, the network interface 1010 illustrated in FIG. 10 may represent one or more wireless interfaces or physical communication interfaces described and illustrated above with respect to particular components of the system 100 of FIG. 1.

In the exemplary embodiment depicted in FIG. 10, the computing device 1000 also includes a storage medium 1008. However, services may be accessed using a computing device that does not include means for persisting data to a local storage medium. Therefore, the storage medium 1008 depicted in FIG. 10 is represented with a dashed line to indicate that the storage medium 1008 is optional. In any event, the storage medium 1008 may be volatile or nonvolatile, removable or nonremovable, implemented using any technology capable of storing information including, but not limited to, a hard disk drive, solid state drive, CD ROM, DVD, or other disk storage, magnetic cassettes, magnetic tape, magnetic disk storage, and/or the like.

As used herein, the term "computer-readable medium" includes volatile and non-volatile and removable and non-removable media implemented in any method or technology capable of storing information, such as computer readable instructions, data structures, program modules, or other data. In this regard, the system memory 1004 and storage medium 1008 depicted in FIG. 10 are merely examples of computer-readable media.

Suitable implementations of computing devices that include a processor 1002, system memory 1004, communication bus 1006, storage medium 1008, and network interface 1010 are known and commercially available. For ease of illustration and because it is not important for an understanding of the claimed subject matter, FIG. 10 does not show some of the typical components of many computing devices. In this regard, the example computing device 1000 may include input devices, such as a keyboard, keypad, mouse, microphone, touch input device, touch screen, and/or the like. Such input devices may be coupled to the example computing device 1000 by wired or wireless connections including RF, infrared, serial, parallel, Bluetooth, Bluetooth low energy, USB, or other suitable connections protocols using wireless or physical connections. Similarly, the example computing device 1000 may also include output devices such as a display, speakers, printer, etc. Since these devices are well known in the art, they are not illustrated or described further herein.

While illustrative embodiments have been illustrated and described, it will be appreciated that various changes can be made therein without departing from the spirit and scope of the invention. It is to be understood that the methods and systems described herein are not limited to specific methods, specific components, or to particular implementations. It is also to be understood that the terminology used herein is for the purpose of describing embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

What is claimed is:

1. A system for application of cosmetic designs, the system comprising:

a client computing device configured to generate a cosmetic design;

an applicator array device, comprising:

a substrate; and a plurality of applicator elements disposed on the substrate, together defining an applicator array, each applicator element comprising:

an applicator member having a length substantially orthogonal to an outer surface of the substrate, a first portion of the length extending from the outer surface of the substrate and a second portion of the applicator member extending through the substrate, wherein the first portion defines a first end and the second portion defines a second end opposite the first end; and an applicator surface defined by the first end; and a pigment applicator configured to reversibly couple with the applicator array device and to apply a pigment to a subset of the plurality of applicator members, wherein the pigment applicator comprises control circuitry, communication circuitry, and a controllable pigment applicator head, wherein the pigment applicator is configured to electronically couple with the client computing device, and wherein the pigment applicator is configured to print the pigment onto the subset of the applicator members in accordance with the cosmetic design.

2. The system of claim 1, wherein each applicator element further comprises:

an actuator, disposed on the substrate and operably coupled to the applicator member, the actuator configured to reposition the applicator surface relative to the outer surface by moving the applicator member.

3. The system of claim 2, wherein the actuator comprises a shape memory alloy, a micromotor, an electromagnetic coil, a pneumatic circuit, or a piezoelectric material.

4. The system of claim 1, wherein the applicator element further comprises a spring assembly mechanically coupled with the second portion to oppose motion of the applicator surface toward the outer surface.

5. The system of claim 1, wherein each applicator element further comprises a compliant material disposed on the applicator surface.

6. The system of claim 5, wherein the compliant material comprises a porous material.

7. The system of claim 1, wherein:

the applicator array device further comprises a source of electromagnetic radiation in an energy range, the source being optically coupled with the applicator array;

each applicator member comprises an optical material that is substantially transparent to electromagnetic radiation in the energy range; and each applicator member is optically coupled with the source to conduct the electromagnetic radiation to the applicator surface.

8. The system of claim 1, wherein each applicator element further comprises an electroactive polymer actuator disposed at the first end, the electroactive polymer actuator comprising:

a first electrode;

an electroactive polymer layer electronically coupled with the first electrode;

a second electrode, electronically coupled with the electroactive polymer layer, wherein the electroactive polymer actuator switches between a first position and a second position in accordance with an applied voltage to the electroactive polymer layer; and a flexible layer overlying the electroactive polymer actuator and defining the applicator surface, wherein the applicator surface is recessed within the applicator member when the electroactive polymer actuator is in the second position, and wherein the applicator surface extends proud of the first end when the electroactive polymer actuator is in the first position.

9. The system of claim 1, further comprising:

a pigment reservoir; and a fluid conduit coupled with the pigment reservoir;

wherein the applicator member further comprises a channel coupled with the pigment reservoir via the fluid conduit, the channel terminating at the applicator surface.

10. The system of claim 1, further comprising:

one or more processors;

control circuitry electronically coupled with the one or more processors and the applicator elements; and a non-transitory computer readable memory in electronic communication with the one or more processors and storing instructions that, when executed by the one or more processors, cause the one or more processors to perform operations comprising:

receiving a cosmetic design describing a configuration of the applicator elements; and initializing the applicator array in accordance with the design, wherein initializing the plurality of applicator elements comprises repositioning a subset of the applicator members relative to the outer surface.

11. The system of claim 1, wherein the subset is a first subset, and wherein:

the applicator array device is electronically coupled with the client computing device;

the applicator array device is configured to receive the cosmetic design from the client computing device or the pigment applicator; and the applicator array device is configured to initialize the applicator array in accordance with the cosmetic design, wherein initializing the applicator array comprises retracting a second subset of the applicator members toward the outer surface, the second subset being different than the first subset.

12. The system of claim 1, further comprising a camera, wherein the client computing device comprises one or more processors and a non-transitory computer readable medium storing instructions that, when executed by the one or more processors of the client computing device, cause the one or more processors to execute operations comprising:

capturing an image describing a target body surface using the camera;

generating a surface mapping of the target body surface using the image; and generating the cosmetic design using the surface mapping.

13. The system of claim 12, wherein generating the cosmetic design comprises defining a plurality of relative positions corresponding to the applicator elements, and wherein the relative positions together define a negative surface complementary to the target body surface, thereby reflecting contours of the target body surface.

* * * * *